US005744007A

United States Patent [19]

Trokhan et al.

[11] Patent Number: 5,744,007

[45] Date of Patent: Apr. 28, 1998

[54] VACUUM APPARATUS HAVING TEXTURED WEB-FACING SURFACE FOR CONTROLLING THE RATE OF APPLICATION OF VACUUM PRESSURE IN A THROUGH AIR DRYING PAPERMAKING PROCESS

[75] Inventors: Paul Dennis Trokhan, Hamilton; Donald Eugene Ensign, Cincinnati, both of Ohio

[73] Assignee: The Procter & Gamble Company, Cincinnati, Ohio

[21] Appl. No.: 706,915

[22] Filed: Sep. 3, 1996

[51] Int. Cl.[6] ..... D21F 1/52

[52] U.S. Cl. ..... 162/374; 162/306; 162/363

[58] Field of Search ..... 162/306, 363, 162/364, 351, 352, 374, 217

[56] References Cited

U.S. PATENT DOCUMENTS

| | | | |
|---|---|---|---|
| 3,066,068 | 11/1962 | Colehuff | 162/374 |
| 3,149,029 | 9/1964 | Stevenson | 162/374 |
| 3,301,746 | 1/1967 | Sanford et al. | 162/113 |
| 3,537,955 | 11/1970 | Huerta et al. | 162/306 |
| 3,994,771 | 11/1976 | Morgan, Jr. et al. | 162/113 |
| 4,133,713 | 1/1979 | Chuang | 162/216 |
| 4,191,609 | 3/1980 | Trokhan | 162/113 |
| 4,406,739 | 9/1983 | Kankaanpaa | 162/306 |
| 4,529,480 | 7/1985 | Trokhan | 162/109 |
| 4,556,450 | 12/1985 | Chuang et al. | 162/204 |
| 4,637,859 | 1/1987 | Trokhan | 162/109 |
| 5,274,930 | 1/1994 | Ensign et al. | 34/23 |
| 5,334,289 | 8/1994 | Trokhan et al. | 162/358.2 |
| 5,338,408 | 8/1994 | Marx, Jr. | 162/301 |
| 5,437,107 | 8/1995 | Ensign et al. | 34/117 |
| 5,514,523 | 5/1996 | Trokhan et al. | 430/320 |
| 5,562,807 | 10/1996 | Baluha | 162/352 |

FOREIGN PATENT DOCUMENTS

| | | | |
|---|---|---|---|
| 1291642 | 2/1987 | U.S.S.R. | 162/363 |
| WO 96/13635 | 5/1996 | WIPO . | |
| WO 96/30590 | 10/1996 | WIPO . | |

*Primary Examiner*—Karen M. Hastings

*Attorney, Agent, or Firm*—Vladimir Vitenberg; Larry L. Huston; E. Kelly Linman

[57] ABSTRACT

A papermaking vacuum apparatus having a web-facing surface adapted to support a papermaking belt and comprising a head, a body and at least one vacuum slot disposed in the head and defining an aperture on the web-facing surface. The vacuum slot is in fluid communication with the web-facing surface and extends from the web-facing surface to the body which is in further fluid communication with a vacuum source. The web-facing surface comprises a textured area in the region of the web-facing surface juxtaposed with the aperture defined by the vacuum slot. This textured area creates a leakage of at least about 35 Marlatts at a pressure differential of 7 inches of Mercury. This leakage eliminates the vacuum seal between a smooth backside of the papermaking belt and the web-facing surface of the vacuum apparatus.

15 Claims, 17 Drawing Sheets

VACUUM APPARATUS HAVING TEXTURED WEB-FACING SURFACE FOR CONTROLLING THE RATE OF APPLICATION OF VACUUM PRESSURE IN A THROUGH AIR DRYING PAPERMAKING PROCESS

FIELD OF THE INVENTION

The present invention generally relates to vacuum apparatuses useful in papermaking machines for making strong, soft, absorbent paper products. More particularly, this invention is concerned with vacuum apparatuses having a controlled application of the vacuum.

BACKGROUND OF THE INVENTION

One pervasive feature of daily life in modern industrialized societies is the use of paper products for a variety of purposes. Paper towels, facial tissues, toilet tissue, and the like are in almost constant use. The large demand for such paper products has created a demand for improved versions of the products and of the methods of their manufacture. Despite great strides in papermaking, research and development efforts continue to be aimed at improving both the products and their processes of manufacture.

Paper products such as paper towels, facial tissues, toilet tissue, and the like are made from one or more webs of tissue paper. If the products are to perform their intended tasks and to find wide acceptance, they, and the tissue paper webs from which they are made, must exhibit certain physical characteristics. Among the more important of these characteristics are strength, softness, and absorbency.

Strength is the ability of a paper web to retain its physical integrity during use.

Softness is the pleasing tactile sensation customers perceive when they crumple the paper in their hands and when they use the paper for its intended purposes.

Absorbency is the characteristic of the paper which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also important. In addition, when the paper is formed into a product such as a towel or wipe, the ability of the paper to cause a fluid to be taken up into the paper and thereby leave a dry wiped surface is also important.

Processes for the manufacturing of paper products for use in tissue, toweling and sanitary products generally involve the preparation of an aqueous slurry of paper fibers and then subsequently removing the water from the slurry while contemporaneously rearranging the fibers in the slurry to form a paper web. Various types of machinery can be employed to assist in the dewatering process.

Currently, most manufacturing processes either employ machines which are known as Fourdrinier wire papermaking machines or machines which are known as twin wire paper machines. In Fourdrinier wire papermaking machines, the paper slurry is fed onto the top surface of a traveling endless belt, which serves as the initial papermaking surface of the machine. In twin wire machines, the slurry is deposited between a pair of converging forming wires in which the initial dewatering and rearranging in the papermaking process are carried out.

After the initial forming of the paper web on the Fourdrinier wire or forming wires, both types of machines generally carry the paper web through a drying process or processes on another piece of papermaking clothing in the form of an endless belt which is often different from the Fourdrinier wire or forming wires. This other clothing is sometimes referred to as a drying fabric or belt. While the web is on the belt, the drying or dewatering process can involve vacuum dewatering, drying by blowing heated air through the paper web, a mechanical processing in combination with a papermaking felt and subsequent compaction of at least a portion of the paper web.

Vacuum dewatering of the paper web is usually performed by a vacuum apparatus, which is used for applying a fluid pressure differential to the embryonic web. The forming wire carries the web from the forming section to a pick-up shoe, and then to a vacuum box. The pick-up shoe pulls water into the web from the wire, and then out of the web into the belt. The belt takes the web away from the wet transfer point to the press section. The pick up shoe transfers the web from the wire to the belt by vacuum applied through a pick up shoe vacuum slot.

An example of paper webs which have been widely accepted by the consuming public are those made by the process described in U.S. Pat. No. 3,301,746 issued to Sanford and Sisson on Jan. 31, 1967. Other widely accepted paper products are made by the process described in U.S. Pat. No. 3,994,771 issued to Morgan and Rich on Nov. 30, 1976 and U.S. Pat. No. 4,191,609 issued to Trokhan on Mar. 4, 1980. Despite the high quality of products made by these two processes, however, the search for still improved products has, as noted above, continued.

A commercially significant improvement was made upon the above paper webs by the process described in the commonly assigned U.S. Pat. No. 4,529,480 issued to Trokhan on Jul. 16, 1985, which is incorporated by reference herein. The improvement included utilizing a papermaking belt (which was termed a "deflection member") comprised of a foraminous woven member which was surrounded by a hardened photosensitive resin framework. The resin framework was provided with a plurality of discrete, isolated, channels known as "deflection conduits." The process in which this deflection member was used involved, among other steps, associating an embryonic web of papermaking fibers with the top surface of the deflection member and applying a vacuum or other fluid pressure differential to the web from the backside (machine-contacting side) of the deflection member. The papermaking belt used in this process was termed a "deflection member" because the papermaking fibers would be deflected into and rearranged into the deflection conduits of the hardened resin framework upon the application of the fluid pressure differential. By utilizing the aforementioned improved papermaking process, as noted below, it was finally possible to create paper having certain desired preselected characteristics.

The paper produced using the process disclosed in U.S. Pat. No. 4,529,480 is described in the commonly assigned U.S. Pat. No. 4,637,859, issued in the name of Trokhan, which is incorporated herein by reference. This paper is characterized by having two physically distinct regions distributed across its surfaces. One of the regions is a continuous network region which has a relatively high density and high intrinsic strength. The other region is one which is comprised of a plurality of domes which are completely encircled by the network region. The domes in the latter region have relatively low densities and relatively low intrinsic strengths compared to the network region.

The paper produced by the process described in U.S. Pat. No. 4,529,480 was stronger, softer, and more absorbent than similar paper produced by the preceding processes as a result of several factors. The strength of the paper produced was increased as a result of the relatively high intrinsic strength provided by the continuous network region. The softness of the paper produced was increased as a result of the provision of the plurality of low density domes across the surface of the paper.

Although the aforementioned improved process worked quite well, it has been found that when the deflection member of the above-described process passed over vacuum dewatering equipment (vacuum pick up shoe and vacuum box) used in the papermaking process, certain undesirable events occurred. Of most concern is the large number of partially dewatered mobile fibers in the paper web which pass completely through the deflection member. This leads to the undesirable clogging of the vacuum dewatering machinery with the more mobile paper fibers. Another undesirable occurrence is the tendency of these mobile paper fibers to accumulate on the dewatering machinery until clumps of fibers are created. This accumulation of fibers causes papermaking belts which have smooth backsides to wrinkle and develop folds, particularly longitudinal folds. The folds cause severe problems with the moisture and physical property profiles of the paper and eventual failure of the papermaking belt.

The issues which developed when using the smooth backsided papermaking belts in combination with the vacuum equipment having a smooth surface have been at least partially the result of the extremely sudden application of vacuum pressure to the paper web when it passes over the vacuum dewatering machinery. The smooth backside surface of papermaking belt combined with the smooth surface of the vacuum dewatering machinery temporarily create a seal over the vacuum source. Then, when the open channels (the deflection conduits) of the papermaking belt are encountered, the vacuum pressure is very suddenly applied to the highly mobile fibers situated on top of the resin framework. This sudden application of the vacuum pressure is believed to cause the sudden deflection of the mobile fibers which causes them to pass completely through the papermaking belt. It is also believed that this sudden application of vacuum pressure and migration of fibers account for pin-sized holes in the dome regions of the finished paper (or pinholing), which are usually undesirable.

The commonly assigned U.S. Pat. No. 5,334,289 issued to Trokhan et al. on Aug. 2, 1994, and incorporated by reference herein, discloses an improved papermaking belt and a method of making the same, which mitigate the undesirable phenomena of pinholing and buildup of the mobile papermaking fibers on the vacuum dewatering machinery. The disclosed papermaking belt has a backside comprising a network with passageways that provide surface texture irregularities in the backside network. The passageways allow air to enter between the backside surface of the papermaking belt and a web-facing surface of the vacuum apparatus. It is believed that this entry of air significantly reduces or even eliminates the vacuum seal between the backside surface of the belt and the web-facing surface of the vacuum apparatus and, as a result, provides a gradual, or more incremental deflection of the fibers in the embryonic web.

Still, a search for improved products has continued.

It is an object of the present invention to provide an improved papermaking process in which the migration of the aforementioned mobile paper fibers is substantially reduced.

It is another object of the present invention to provide a papermaking vacuum apparatus which will significantly mitigate or eliminate the undesirable application of a sudden vacuum pressure to the paper web.

It is another object of the present invention to provide a papermaking vacuum apparatus which will substantially reduce the problem of the buildup of paper fibers on the vacuum dewatering machinery.

It is also an object of the present invention to provide a papermaking vacuum apparatus which will help to significantly reduce pin-sized holes in the finished paper web (unless such holes are a desirable characteristic for the particular paper being produced).

These and other objects of the present invention will be more readily apparent when considered in reference to the following description and when taken in conjunction with the accompanying drawings.

SUMMARY OF THE INVENTION

A papermaking vacuum apparatus comprising a vacuum pick up shoe and a vacuum box is provided. The vacuum apparatus comprises a head having a web-facing surface adapted to support a backside of a papermaking belt having a paper web thereupon, and a body joined to the head. The web-facing surface comprises at least one leading surface and at least one trailing surface. At least one vacuum slot is disposed in the head of the vacuum apparatus. This at least one vacuum slot defines an aperture on the web-facing surface between the leading surface and the trailing surface. The vacuum slot is in fluid communication with the web-facing surface and extends from the web-facing surface to the body which is in further fluid communication with a vacuum source.

In one aspect of the present invention, a papermaking vacuum apparatus has a web-facing surface comprising a textured area in the region of the web-facing surface juxtaposed with the aperture defined by the vacuum slot. This textured area creates a leakage of at least about 35 Marlatts at a pressure differential of 7 inches of Mercury. The leakage reduces or eliminates a vacuum seal between the smooth backside surface of the papermaking belt and the web-facing surface of the vacuum apparatus.

In another aspect of the present invention, the web-facing surface of the vacuum apparatus has a textured clothing interposed between the web-facing surface of the vacuum apparatus and the backside surface of the papermaking belt. The textured clothing creates leakage between the papermaking belt's backside surface and the web-facing surface of the vacuum apparatus and thus effectively reduces or eliminates the vacuum seal between these two surfaces. In one preferred embodiment, the textured clothing comprises an endless textured belt adapted to travel around the vacuum apparatus.

In another aspect of the present invention, the leading surface of the vacuum apparatus has a transitional area juxtaposed with the aperture created by the vacuum slot. This transitional area has a predetermined Z-directional spacing from the papermaking belt, which Z-spacing increases in the machine direction whereby the amount of vacuum pressure applied through the vacuum slot to the paper web increases as the paper web travels in the machine direction over the vacuum slot.

In another aspect of the present invention, a flow management device is utilized in the vacuum apparatus. The flow management device is disposed such that the papermaking belt having the paper web thereupon travels between the flow management device and the paper-facing surface of the vacuum apparatus. The flow management device has an air flow resistance and is adapted to control the distribution in the machine direction of the air flow through the vacuum slot of the vacuum apparatus.

In still another aspect of the present invention, the vacuum apparatus comprises a plurality of sequenced vacuum sections successively spaced in the machine direction from a first vacuum section to a last vacuum section. Each vacuum section comprises at least one vacuum slot in fluid communication with the web-facing surface and defining an aperture thereon. Each vacuum section has a resulting open area on the web-facing surface and a vacuum applied therethrough, this vacuum increasing from the first vacuum section to the last vacuum section, thereby creating a gradual build up of a vacuum. Preferably, each vacuum applied through any successive vacuum section is at least about 20% greater than the vacuum applied through a preceding vacuum section.

DETAILED DESCRIPTION OF THE INVENTION

Figure 1:
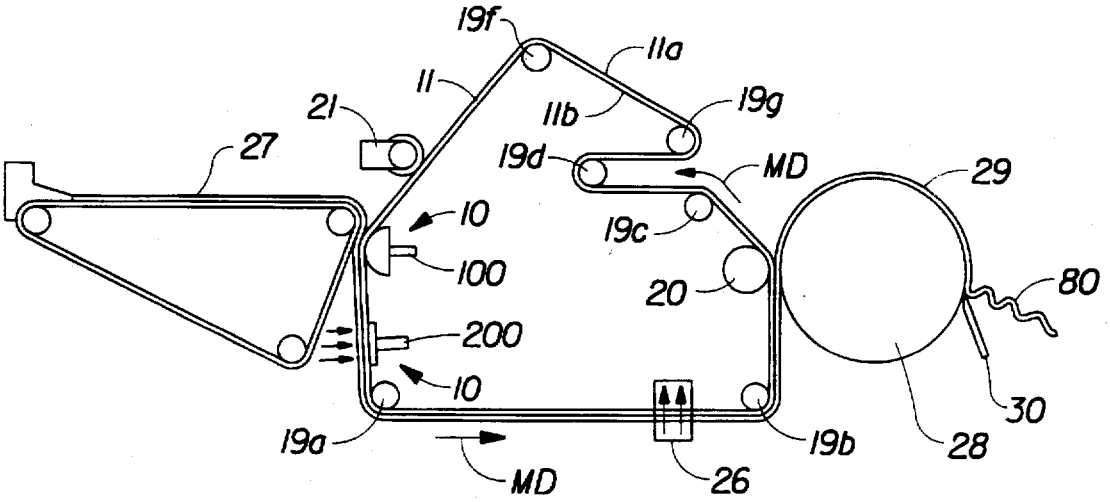
FIG. 1 is a schematic side elevational representation of one embodiment of a continuous papermaking machine useful in utilizing a vacuum apparatus of this invention.

In the representative papermaking machine illustrated in FIG. 1, the papermaking vacuum apparatus 10 of the present invention comprises a vacuum pick-up shoe 100 and a vacuum box 200. As used herein, the term "vacuum apparatus" is generic, referring to both kinds of vacuum apparatuses employed in the papermaking process described herein: the vacuum box 200 and the vacuum pick up shoe 100. Throughout this application the examples will be made and particular embodiments will be shown using either the vacuum box 200 or the vacuum pick up shoe 100 for illustration. One skilled in the art will readily recognize that regardless of the particular embodiment shown (either vacuum box 200 or vacuum pick up shoe 100), the present invention is applicable to the generic papermaking "vacuum apparatus 10" as this term is defined hereabove.

In FIG. 1, a papermaking belt 11 carries a paper web (or "fiber web") 27 through various stages of its formation. The belt 11 travels in the machine direction indicated by a directional arrow MD around return rolls 19*a* and 19*b*, impression nip roll 20, papermaking belt return rolls 19*c*, 19*d*, 19*e* and 19*f*, and emulsion distributing roll 21. In FIG. 1, the papermaking belt 11 also travels around a predryer such as blow-through dryer 26, and passes between a nip formed by the impression nip roll 20 and a Yankee dryer drum 28. As shown in FIGS. 1 and 2, the papermaking belt 11 has a web-contacting surface 11*a* and a backside (or machine-facing) surface 11*b*. The web-contacting surface 11*a* of the belt 11 is the surface of the belt 11 which contacts the paper web 27 to be dewatered and rearranged into the finished product. The opposed surface of the belt 11, the backside surface 11*b*, is the surface of the belt 11 which travels over and is generally in contact with the papermaking machinery employed in the papermaking process, including the vacuum apparatus 10 of the present invention.

In papermaking, the term "machine direction" (or MD) refers to that direction which is parallel to the flow of the paper web through the equipment. The "cross-machine direction" (or CD) is perpendicular to the machine direction and lies in the plane of the papermaking belt 11. The machine direction and the cross-machine direction are indicated by the arrows MD and CD, respectively, in several figures of the present application.

Preferably, the papermaking belt 11 utilized in the papermaking process using the vacuum apparatus 10 of the present invention has a relatively high permeability to fluids such as water and air. The preferred air permeability of the belt 11 is greater than 400 cubic feet per minute per square foot of its surface area at a pressure differential of 100 Pascals. Any papermaking belt suitable for use in a drying through process may be utilized in the present invention. U.S. Pat. No. 4,529,480; U.S. Pat. No. 4,514,345; U.S. Pat. No. 4,637,859; and U.S. Pat. No. 5,334,289 disclosing preferred papermaking belts are incorporated by reference herein.

Figure 2A:
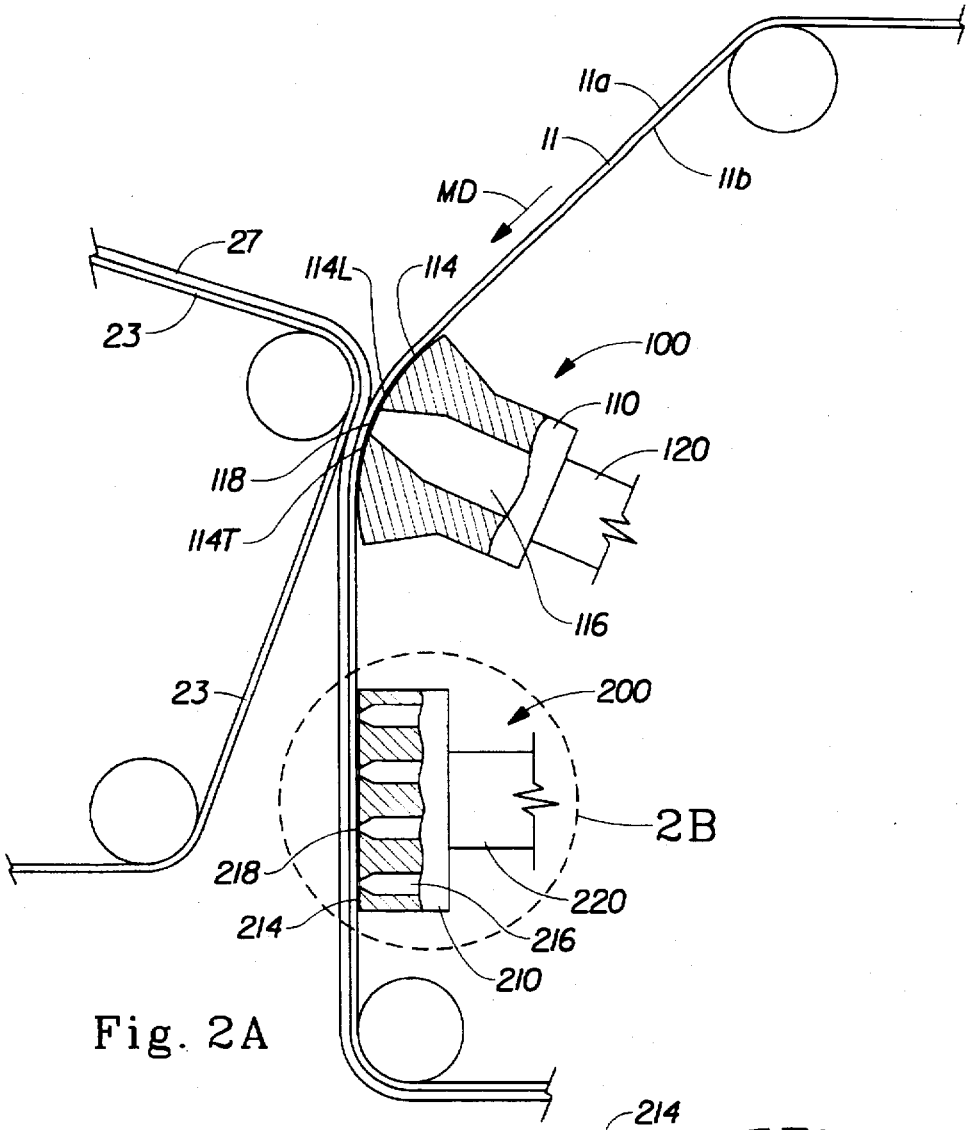
FIG. 2A is a schematic representation of one embodiment of the papermaking vacuum apparatus of the present invention comprising a vacuum pick-up shoe and a vacuum box.

As shown in FIG. 2A, the vacuum pick up shoe 100 comprises a head 110 and a body 120 joined to the head 110. The head 110 has a web-facing surface 114 comprising at least one leading surface 114L and at least one trailing surface 114T. The web-facing surface 114 provides support for belt 11 traveling in the direction of the arrow MD with the web 27 thereupon. Preferably, the backside surface 11*b* of the papermaking belt 11 is in direct contact with the web-facing surface 114 of the vacuum pick up shoe 100. At least one vacuum slot 116 is disposed in the head 110. This at least one vacuum slot 116 defines at least one aperture 118 on the papermaking belt disposed between at least one leading surface 114L and at least one trailing surface 114T.

The vacuum slot 116 extends from the web-facing surface 114 to the body 120. The vacuum slot 116 is in fluid communication with the web-facing surface 114 of the head 110. The body 120 is in further fluid communication with a vacuum source (not shown). As used herein, two or more elements are said to be in "fluid communication" when these elements are capable or adapted to be capable of a transmission (either one-way or reciprocal) of such fluids as air and water. A variety of apparatuses well known in the art and capable of creating vacuum pressure may be used as a vacuum source. An example of a vacuum source includes but is not limited to a vacuum pump.

As best shown in FIG. 2A, the vacuum pick up shoe 100 pulls the web 27 from a wire 23 to the papermaking belt 11 by the vacuum applied through the vacuum slot 116, removing at least part of the surplus water from the web 27. The web-facing surface 114 of the vacuum pick up shoe 110 provides support for the papermaking belt 11 with the web 27 thereupon.

Figure 2B:
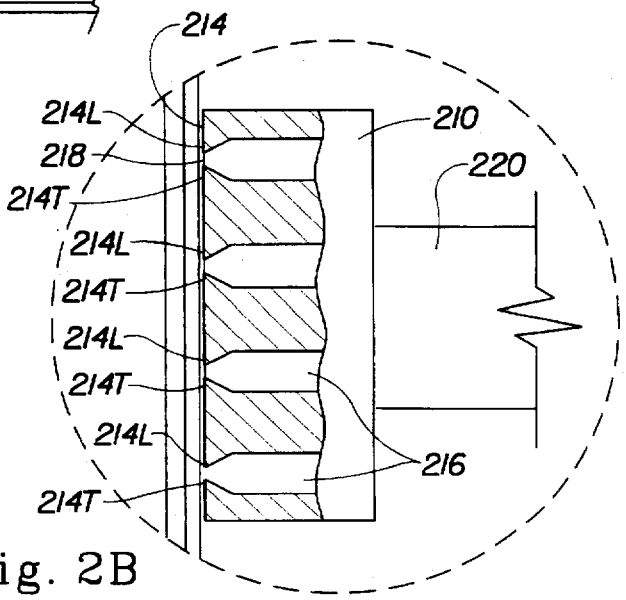
FIG. 2B is a schematic and more detailed representation of the vacuum box shown in FIG. 2A.

In FIGS. 2A and 2B, the vacuum box 200 of the present invention comprises a head 210 and a body 220 joined to the head 210. The head 210 has a web-facing surface 214 comprising at least one leading surface 214L and at least one trailing surface 214T. The web-facing surface 214 provides support for the belt 11 traveling in the direction of the arrow MD with the web 27 thereupon. Preferably, the backside surface 11*b* of the papermaking belt 11 is in direct contact with the web-facing surface 214 of the vacuum box 200. At least one vacuum slot 216 is disposed in the head 212. This at least one vacuum slot 216 defines at least one aperture 218 on the paper-facing surface 214 disposed between at least one leading surface 214L and at least one trailing surface 214T. In the preferred embodiment of the present invention, a vacuum box 200 is a multi-slot vacuum box having at least three vacuum slots 216, at least three web-facing leading surfaces 214L and at least three web-facing trailing surfaces 214T. More preferably, a vacuum box 200 comprises at least four vacuum slots 216, at least four web-facing leading surfaces 214L and at least four web-facing trailing surfaces 214T, as schematically shown in FIGS. 2A and 2B.

Throughout this description, references will be made to the "Z direction," "Z dimension," "Z-directional spacing," or "Z-spacing." As used herein, the "Z direction" ("Z dimension," "Z-directional spacing," or "Z-spacing") is the orientation relating to the web-facing surfaces 114, 214, or portions thereof, of the vacuum pick up shoe 100 and the vacuum box 200, respectively. More particularly, the Z direction refers to those orientations that are perpendicular to the web-facing surfaces 114, 214 at any particular point. It should be noted that the web-facing surfaces 114, 214 may be either planar or non-planar. One skilled in the art will readily understand that if the web-facing surface is planar (as the case may be with the web-facing surface 214 of the vacuum box 200), i.e., if the web-facing surface 214 lies in the x-y plane of a Cartesian coordinate system, the Z direction may be said to be a z-axis of the same Cartesian coordinate system, said z-axis running perpendicular to the x-y plane. At the same time, if the web-facing surface is non-planar (curved, for example, as the case may be with the web-facing surface 114 of the vacuum pick up shoe 100), the Z direction designates the orientation which runs perpendicular to the tangent of a curved surface at a particular point to which the Z direction is applied. One skilled in the art will readily understand that the curved surface need not be a circled surface. The curbed surface may have any configuration suitable for the purposes of the present invention defined herein.

The vacuum apparatuses of prior art utilize vacuum pick up shoes and vacuum boxes having relatively smooth web-facing surfaces. It is believed that the problems which develop when using the prior vacuum apparatuses having smooth web-facing surfaces are at least partially the result of the extremely sudden application of vacuum pressure which is imparted to the paper web when the paper web is carried by the papermaking belt 11 over the vacuum apparatus employed in the papermaking process. It is believed that the prior art smooth web-facing surface of the vacuum apparatus combined with the smooth backside surface of the papermaking belt temporarily creates a seal over the vacuum source. Then, when the deflection conduits of the papermaking belt are encountered, the vacuum pressure is applied in an extremely sudden fashion to the paper web situated on the papermaking belt. This sudden application of the vacuum pressure is believed to cause a sudden deflection of the very mobile fibers in the fibrous web, which deflection is sufficient to allow these mobile fibers to pass completely through the papermaking belt. The difference between the deflection of fibers in the fibrous web when using a prior art vacuum apparatus and when using the vacuum apparatus 10 of the present invention is illustrated schematically in FIGS. 3A and 3B and graphically in FIG. 4.

Figure 3A:
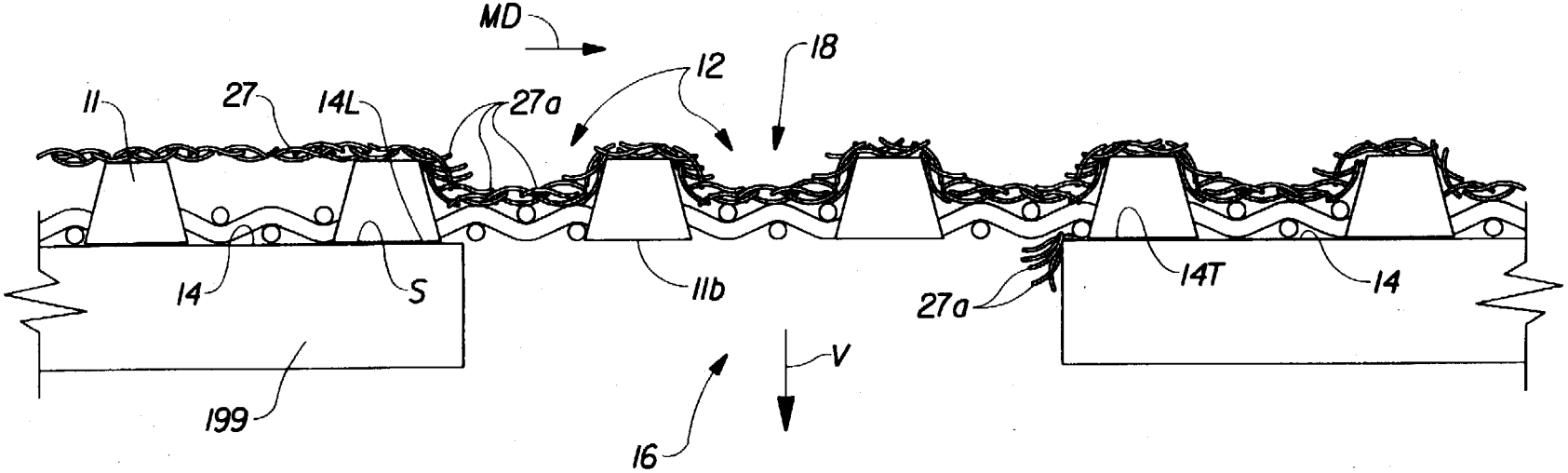
Fig. 3A (Prior Art)
FIG. 3A is a simplified schematic cross-sectional representation of a vacuum apparatus of the prior art illustrating what happens when a smooth backside papermaking belt carrying a web thereupon encounters a vacuum apparatus of prior art having a smooth web-facing surface.
Figure 3B:
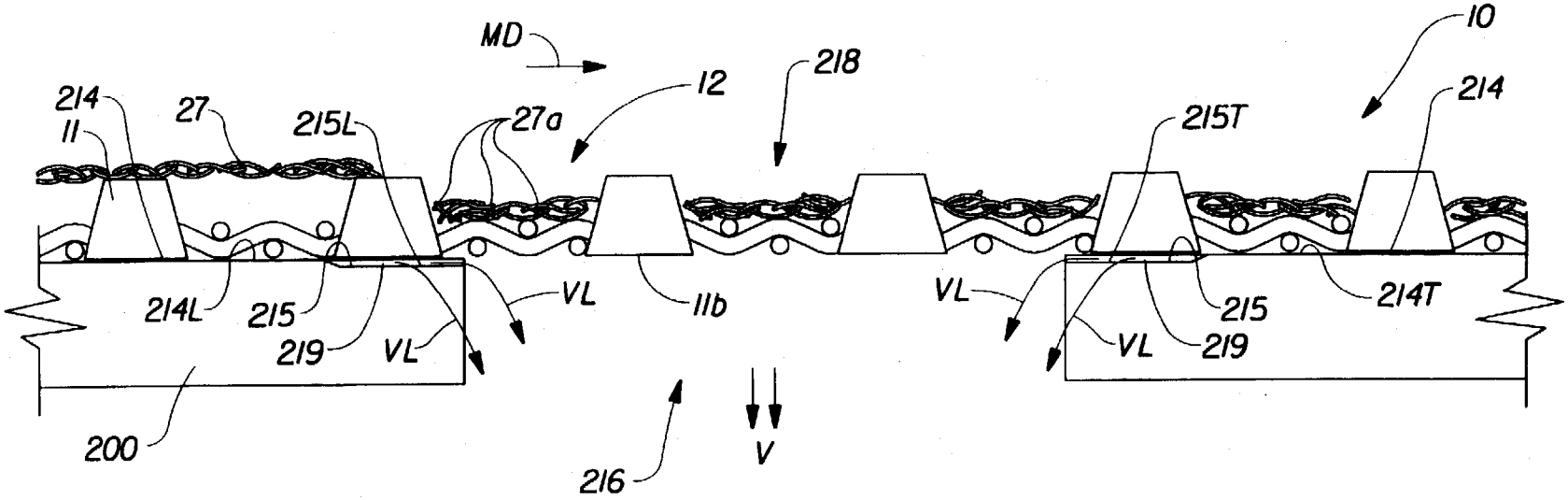
FIG. 3B is a simplified cross-sectional representation of the vacuum apparatus of the present invention having a textured web-facing surface.
Figure 4:
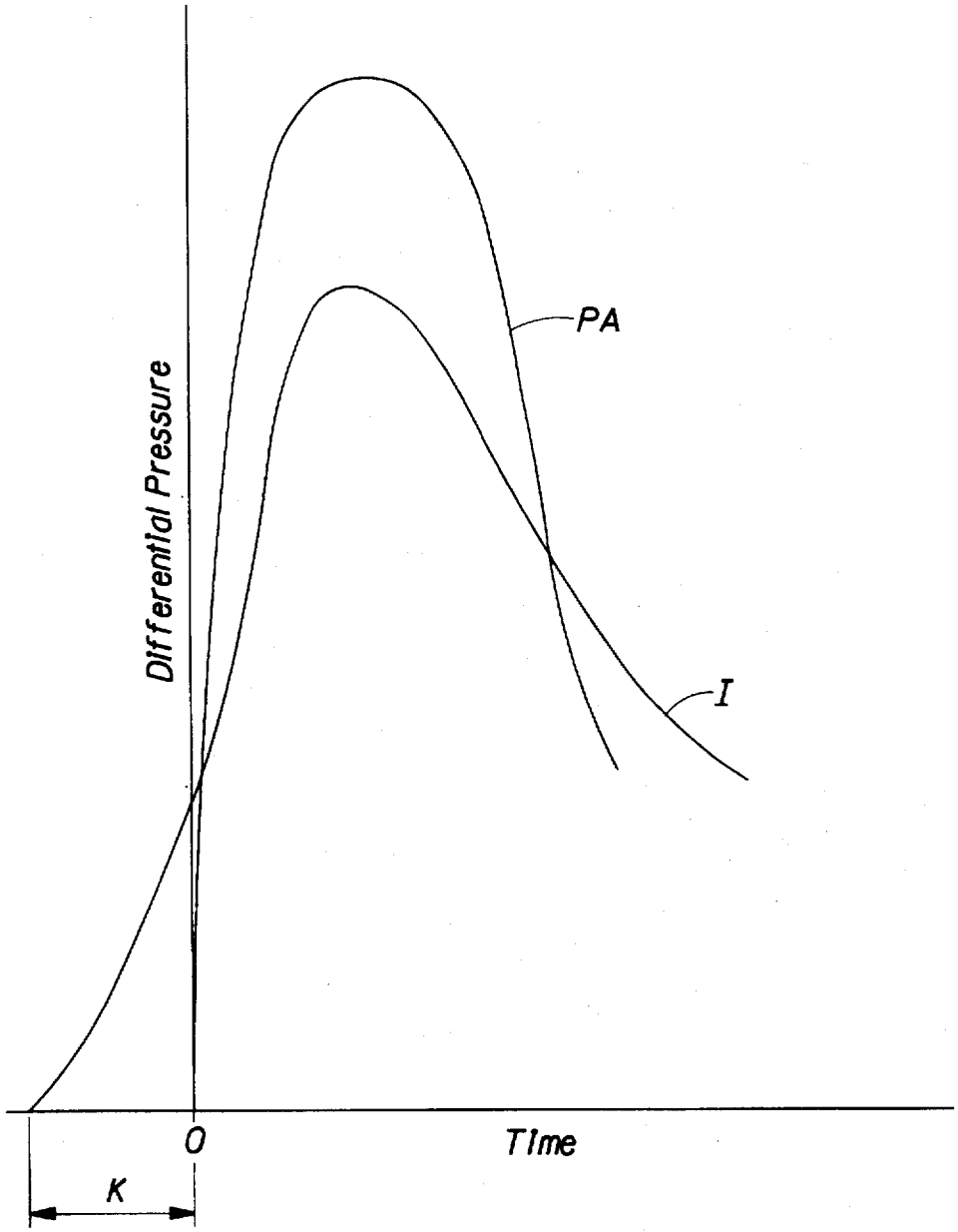
FIG. 4 is a graphical representation which depicts the application of the vacuum pressure to a paper web through a smooth backside belt using both the vacuum apparatus of the prior art having a smooth web-facing surface and the vacuum apparatus of the present invention having a textured web-facing surface disclosed herein.

FIG. 3A is a representation of what is believed to occur when the papermaking belts having smooth backside surfaces and carrying a paper web encountered the vacuum dewatering equipment of the prior art having a smooth web-facing surface, such as a vacuum box 199. FIG. 3B is a representation of what is believed to occur when the papermaking belt carrying a paper web encounters the vacuum apparatus 10 of the present invention, such as vacuum box 200. FIG. 4 is a graphical representation of the application of the vacuum pressure (differential pressure) to the papermaking belt 11 having the embryonic web 27 thereon and moving across a vacuum slot 16 of a vacuum box 199 of the prior art and the vacuum slot 216 of the vacuum apparatus 10 of the present invention.

As schematically shown in FIGS. 3A and 3B, the papermaking belt 11 carries a web 27 in the machine direction MD (from left to right in the figures). In FIG. 3A, a portion of the belt 11 passes over the single slot 16 of the prior art vacuum box 199 having a smooth web-facing surface 14. The portion of the web-facing surface 14 shown includes a leading surface 14L which is first encountered when the papermaking belt 11 with the paper web 27 thereupon travels in the machine direction, and a trailing surface 14T which is the web-facing surface 14 of the vacuum box 199 which is encountered after the papermaking belt 11 passes over the vacuum slot 16. A vacuum V is applied from a vacuum source (not shown), which exerts pressure on the belt 11 and the embryonic web 27 in the direction of the arrows V shown. The vacuum V removes some of the water from the embryonic web 27 and deflects and rearranges individual fibers **27*a* of the embryonic web 27 into conduits 12 of the papermaking belt 11**.

In FIG. 3A, because of the smooth nature of the web-facing surface 14, a vacuum seal is created between the smooth and continuous backside surface **11*b* of the papermaking belt 11 and the leading web-facing surface 14L of the vacuum box 199 of prior art at the place designated by the reference letter S. When the belt 11 travels in the machine direction, the vacuum slot 16 is encountered, the vacuum seal is suddenly broken, and the vacuum pressure V is suddenly applied to the embryonic web 27. This causes a sudden deflection of the fibers 27*a* of the embryonic web 27 into the conduits 12, and some of the more mobile fibers 27*a* to pass entirely through the belt 11 and accumulate on the edge of the trailing surface 14T of the vacuum box 199. It has been found that these mobile fibers 27*a* will accumulate until eventually they build up into clumps of fibers on the trailing surface 14T, creating ridges for papermaking belt 11** to travel over.

FIG. 3B schematically shows the fragment of the vacuum box 200 of the present invention. Analogously to the drawing shown in FIG. 3A, the papermaking belt 11 carries the web 27 over the single slot 216 of the vacuum box 200 of the present invention, having the web-facing surface 214. The portion of the web-facing surface 214 includes the leading web-facing surface 214L and the trailing web-facing surface 214T. A vacuum V is applied from a vacuum source (not shown), which exerts pressure on the belt 11 and the embryonic webs 27 in the direction of the arrows V shown.

As FIG. 3B shows, at least a part of the web-facing surface 214 of the vacuum box 200 has an area 215 adjacent the aperture 218. The area 215 comprises a leading surface or area 215L disposed on the leading web-facing surface 214L and a trailing surface or area 215T disposed on the trailing web-facing surface 214T. The area 215 eliminates the vacuum seal between the belt's smooth backside surface **11*b* and the web-facing surface 214. The elimination of the vacuum seal between the belt's backside surface 11*b* and the web-facing surface 214 can be accomplished by a variety of means. For example, the area 215 can be a non-smooth (or "textured") area of the web-facing surface 214. Since the surface of the area 215 is not smooth, passageways 219 exist through which air can enter between the backside surface 11*b* of the papermaking belt 11 and the web-facing surface 214. This entry of air is shown schematically by the large arrows VL (vacuum leakage). As shown in FIG. 3B, the entry of air VL permits a more gradual or incremental deflection of the fibers 27*a* in the web 27. Few, if any, fibers 27*a* pass through the papermaking belt 11 to accumulate on the web-facing surface 214**.

It will readily be understood by one of ordinary skills in the art that while the vacuum box 200 was chosen to illustrate the undesirable consequences of the "vacuum seal" described hereabove, this illustration is equally applicable to the vacuum pick up shoe 100 utilized in the through air drying papermaking processes.

FIG. 4 is a graphical representation of the vacuum pressure (differential pressure) which is applied to the papermaking belt 11 as the papermaking belt 11 shown in FIGS. 3A and 3B moves across the vacuum slot 216 of the vacuum apparatus 10. As the diagrams in FIG. 4 show, the vacuum apparatus 10 of the present invention provides vacuum pressure which increases significantly more gradual over time, compared to the vacuum apparatus of the prior art.

Providing the web-facing surface 214 of the vacuum apparatus 10 with a non-smooth area 215 is one means of eliminating the vacuum seal between the smooth backside surface **11*b* of the papermaking belt 11 and the web-facing surface 214 of the vacuum apparatus 10**. This and other means of eliminating the vacuum seal in order to mitigate the undesirable consequences of the sudden application of the vacuum pressure described hereabove are disclosed in this application in accordance with the objects of the present invention.

Vacuum Apparatus Having Textured Web-Facing Surface

Figure 5A:
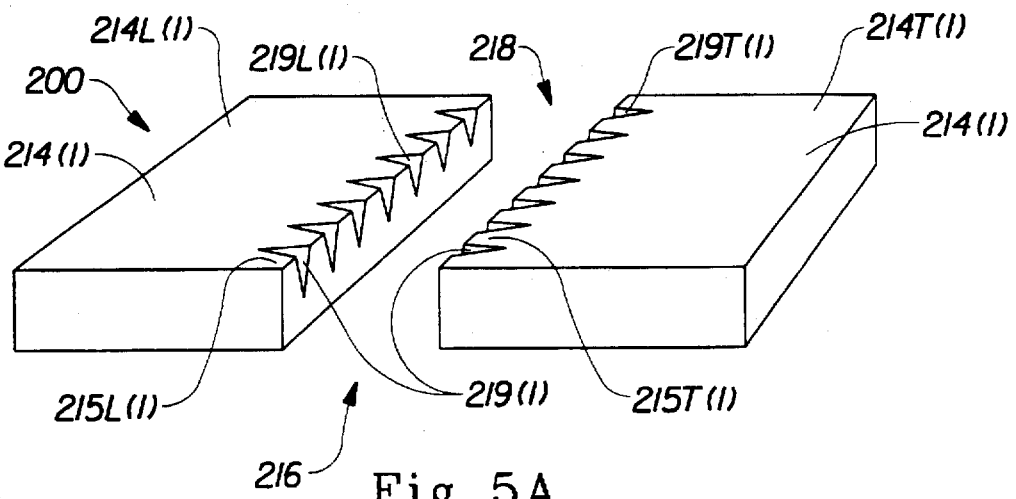
FIG. 5A is a schematic perspective view of one embodiment of the vacuum apparatus of the present invention having a textured web-facing surface comprising a plurality of passageways.

FIG. 5A is a more detailed, while still schematic, representation of one of the embodiments of the web-facing surface 214 of the vacuum box 200 of the present invention. As shown in FIG. 5A, at least part of the web-facing surface 214 of the vacuum box 200 has a "textured" area 215. This textured area can also be referred to as "vacuum apparatus surface texture" or "textured surface." As used herein, the term "texture" refers to the characteristic of the web-facing surface 114, 214 of the vacuum apparatus 10, created by discontinuities or non-planar interruptions in what would ordinarily be a smooth or planar surface. These discontinuities or non-planar interruptions can comprise projections from or depressions in such a smooth surface.

FIGS. 5A through 7 show various types of the textured area 215 that can be provided in accordance with the present invention. It should be understood that the particular types of the textured areas 215 shown in FIGS. 5A through 7 are neither all-inclusive nor exhaustive examples of the textured areas 215 which could be utilized in the vacuum apparatus 10 of the present invention. It should also be carefully noted that the web-facing surfaces 114, 214 may comprise a planar surface, or—alternatively—a non-planar surface.

FIG. 5A is a schematic representation of one of the embodiments of the textured area 215 of the vacuum apparatus 10. As FIG. 5A shows, the textured area 215(1) has a plurality of passageways 219(1) formed by discontinuities on the web-facing surface 214 and adjacent the aperture 218. A leading surface 214L(1) of the vacuum box 200 has a leading textured area 215L(1) comprised of a plurality of leading passageways 219L(1) "cut" through the edge of the leading surface 214L(1). A trailing surface 214T(1) has a trailing textured area 215T(1) comprised of a plurality of trailing passageways 219T(1) "cut" through the edge of the trailing surface 214T(1). While in the embodiment shown in FIG. 5A, the configuration and the number of the leading passageways 214L(1) are the same as the configuration and the number of the trailing passageways 214T(1), their configurations and numbers may differ to the extent that either the leading surface 214L or the trailing surface 214T may have no passageways 219 at all.

As used in this specification, the reference numerals having no numeral characters in parenthesis designate generic terms or elements applicable to a particular features being described herein, regardless of their specific embodiment. Examples include: "web-facing surface 214" of the vacuum box 200, "web-facing surface 114" of the pick up shoe 100, "leading surface 214L" and "trailing surface 214T" of the vacuum box 200, and so on. The reference numerals having characters in parenthesis designate specific embodiments of the elements being or capable of being described generically. Examples include: the vacuum box "leading surface 214L(1) having a plurality of leading passageways 219L(1) . . . ," the vacuum box "leading surface 214L(2) having a plurality of leading passageways 219L(2) in the form of machine direction grooves." In these examples, the numeral "(1)" designates the first embodiment of a particular element of the invention, and the numeral "(2)" designates the second embodiment of the same element of the invention. Thus, the "textured area 215(1)" comprised of the "leading textured area 215L(1)" and the "trailing textured area 215T(1)" is the first embodiment of the textured area 215; and the "textured area 215(2)" comprised of the "leading textured area 215L(2)" and the "trailing textured area 215T(2)" is the second embodiment of the textured area 215.

As used herein, the term "passageways" means openings for fluids, or more specifically, spaces through which air and water may pass along the web-facing surfaces 114, 214 towards the apertures 118, 218. The term "passageways" should not be construed to include spaces that are necessarily of any particular shape and size. Passageways having random shapes and sizes may be used in the present invention. One skilled in the art will recognize that there is an unlimited number of possible combinations of the shapes and relative numbers of the leading passageways and the trailing passageways, which are all included within the scope of the present invention. As used herein, the term "sealing area" means a part of the textured surface 215 which separates the passageways and which is preferably in direct contact with the backside 11*b* of the papermaking belt 11. In the case where the textured area 115, 215 is formed by depressions in an inherently smooth surface, the sealing areas are the areas which are not physically affected by the "texturing" and which retain the characteristic of the inherently smooth surface.

Figure 5B:
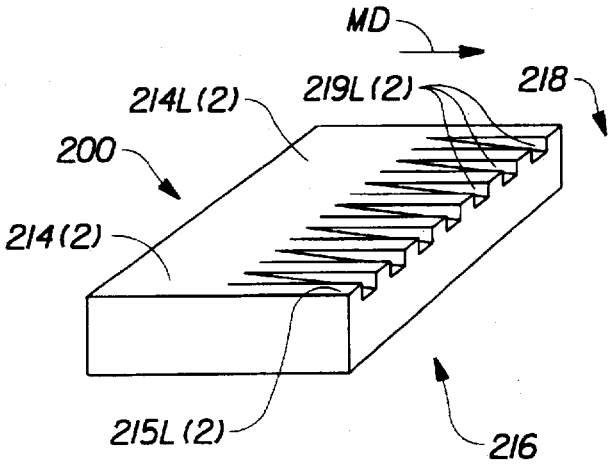
FIG. 5B is a view similar to FIG. 5A showing the vacuum apparatus with a textured web-facing surface comprising machine direction grooves having a rectangular cross section.
Figure 5C:
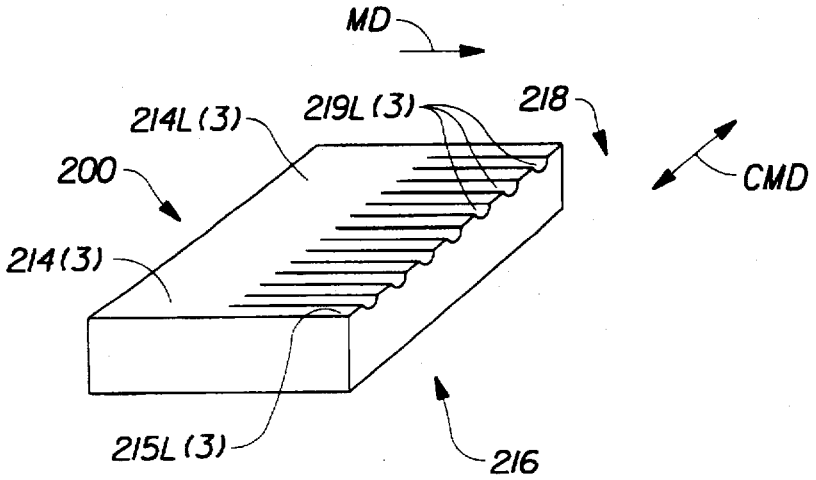
FIG. 5C is a view similar to FIG. 5B showing the vacuum apparatus having a textured web-facing surface comprising machine direction grooves having a circular cross section.
Figure 5D:
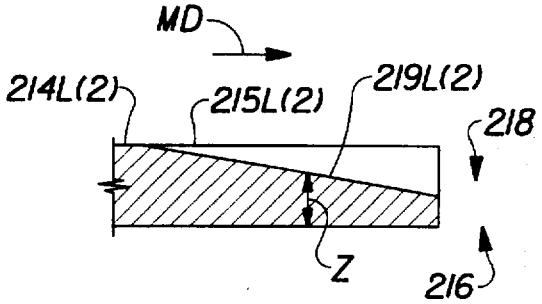
FIG. 5D is a vertical sectional view of one embodiment of a leading textured area of the vacuum apparatus shown in FIGS. 5B and 5C, having a Z-dimension linearly increasing in the machine direction.
Figure 5E:
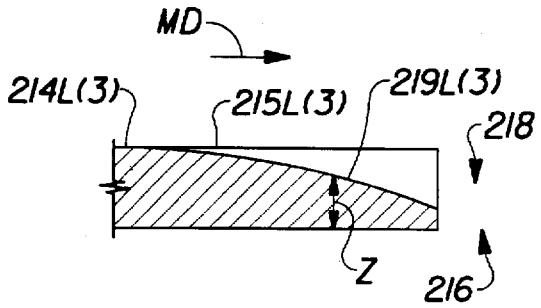
FIG. 5E is a vertical sectional view of one embodiment of a leading textured area of the vacuum apparatus shown in FIGS. 5B and 5C, having a Z-dimension exponentially increasing in the machine direction.

FIGS. 5B, 5C, 5D, 5F and 5G schematically represent other embodiments of the textured area 215 of the vacuum apparatus 10 of the present invention. In the embodiment shown in FIG. 5B and 5C, leading surfaces 214L(2) and 214L(3) have leading passageways 219L(2) and 219L(3), respectively, in the form of comparatively long machine direction grooves. These grooves may have a Z-dimension Z gradually increasing in the machine direction. The Z-dimension Z may increase as a linear function of the position in the machine direction at a certain angle relative the leading surfaces 214L(2) and 214L(3) respectively (FIG. 5D). Alternatively, the Z-dimension Z may increase as an exponential function of the lateral position (FIG. 5E), or any other function, if desired. Also, the Z-dimension Z need not (as shown) be the same throughout the cross-machine direction. A cross-machine profile of the passageways 219L(2) and 219L(3) may comprise various shapes including but not limited to triangles, polygons, and circles. For example, FIG. 5B shows the passageways 219L(2) having a rectangular cross section, while the passageways 219L(3) shown in FIG. 5C have a circular cross section. It will be apparent to one skilled in the art that although FIGS. 5B, 5C, 5D, 5F show only the leading web-facing surfaces 214L(2) and 214L(3) having the leading passageways 219L(2) and 219L (3) respectively, the corresponding trailing surfaces (not shown) may also have trailing passageways (not shown) similar or dissimilar to the leading passageways 219L(2), 219L(3). By analogy, one skilled in the art will recognize that these trailing passageways may have their Z-dimension Z continuously and gradually increasing in the direction opposite the machine direction. It should be carefully noted, however, that because the leading surface 214L is the first encountered when the papermaking belt 11 travels over the vacuum slot 216 in the machine direction, the leading textured area 215L is of primary importance for the purpose of eliminating the vacuum seal between the belt's backside surface 11*b* and the web-facing surface 214. Therefore, in some embodiments, the trailing textured area 215T may be made relatively smaller than the corresponding leading textured area 215L, or be omitted altogether.

Figure 6A:
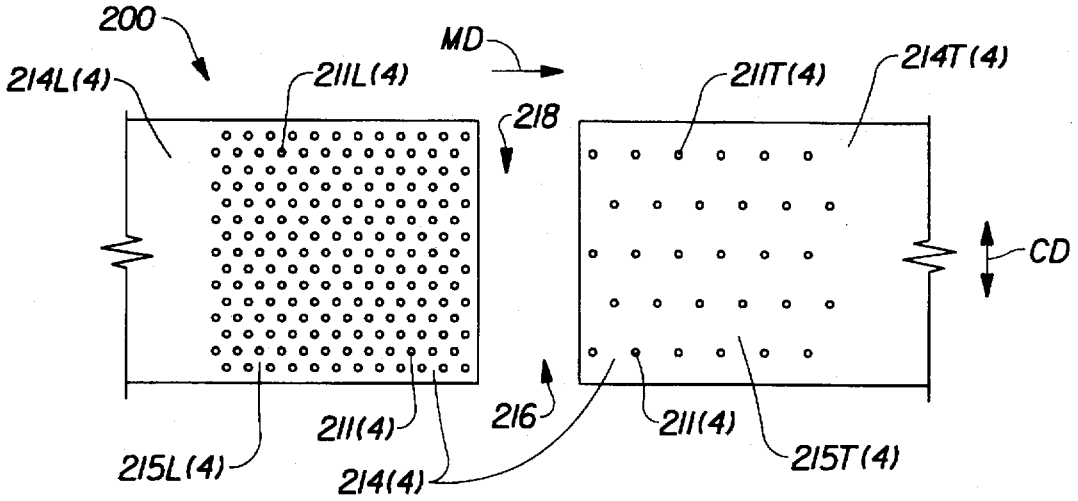
FIG. 6A is a simplified top plan view of a textured surface comprising protrusions extending outwardly in the Z-direction.
Figure 6B:
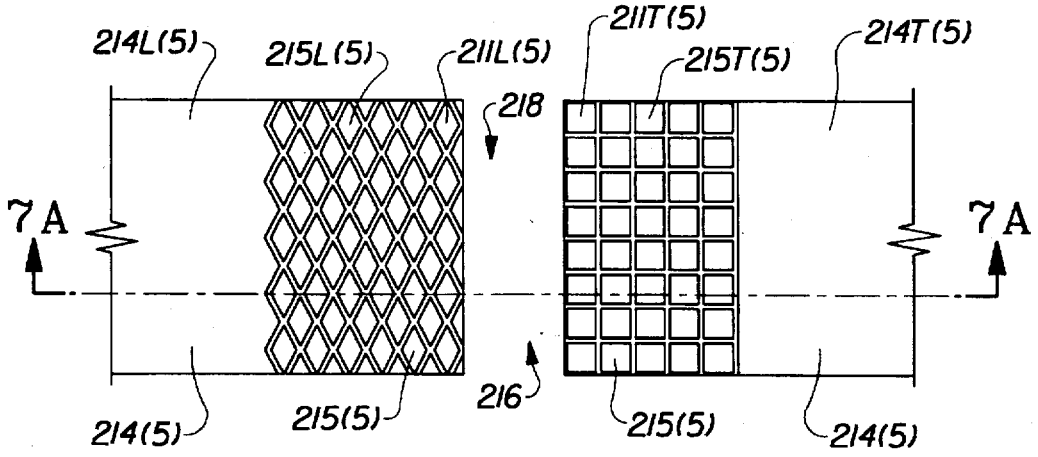
FIG. 6B is a view similar to FIG. 6A showing a textured surface comprising a network of intersecting grooves.

FIG. 6A shows the textured area 215 formed by raised protrusions 211(4) extending outwardly in Z-direction from the web-facing surface 214. In FIG. 6A, the raised protrusions 211(4) comprise leading surface protrusions 211L(4) disposed on the leading web-facing surface 214 and trailing surface protrusions 211T(4) disposed on the trailing web-facing surface 214T. The raised protrusions 211(4) may be of various shapes and configurations and may define various overall patterns in the x-y plane. For example, FIG. 6B shows protrusions 211L(5) having a rhomboidal shape in the x-y plane and disposed on the leading surface 214L(5) in a non-random repeating pattern. In FIG. 6B, protrusions 211T (5) have a square shape in the x-y plane and are disposed on the trailing surface 214T(5) in a non-random repeating pattern. The embodiments shown in FIG. 6B and many other patterns, such as reticulated networks, may be provided by grooving the web-facing surface 214 in two or more directions. In FIG. 6B, the textured area 215L(5), 215T(5) comprises a plurality of sealing areas which are discrete relative to each other in both the machine direction and the cross-machine direction. The sealing areas are separated from one another by a continuous reticulated network passageways extending in two mutually intersecting directions. The passageways are in fluid communication with the vacuum slot 216 and provide leakage between the web-facing surface 214 and the papermaking belt 11 (not shown in FIG. 6B for clarity). Viewed in plan view, the plurality of sealing areas preferably forms a non-random repeating pattern, as shown in FIG. 6B, such, for example, as bilaterally staggered array (215L(5 ).

Figure 5F:
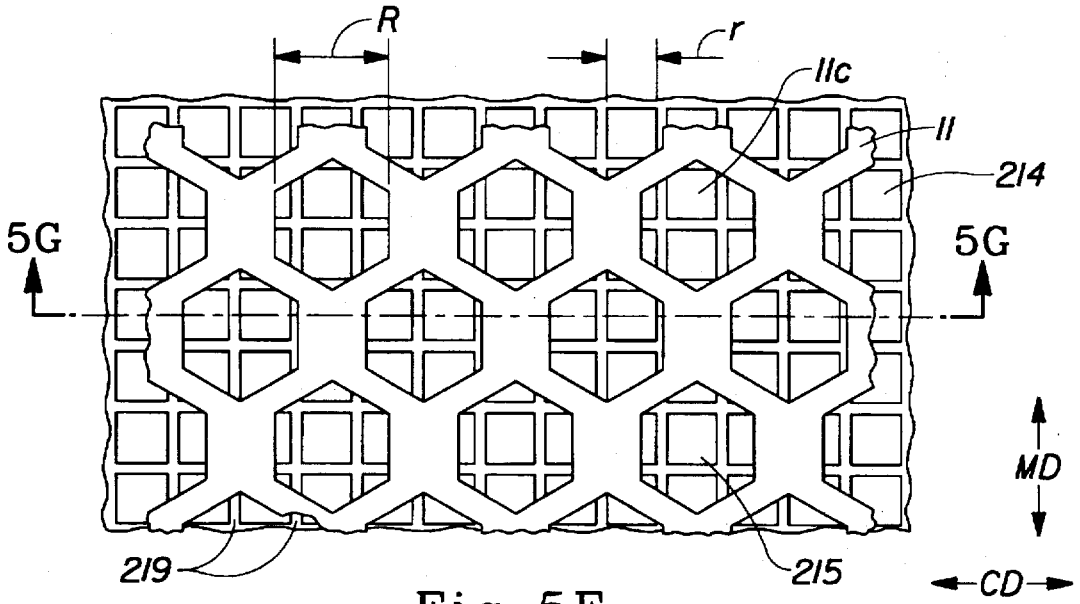
FIG. 5F is a simplified top plan view of a papermaking belt having deflection conduits, interposed with a textured surface having sealing areas, the cross-machine dimensions of the sealing areas being less than the cross-machine dimensions of the deflection conduits. A reinforcing structure of the belt is not shown for clarity.
Figure 5G:
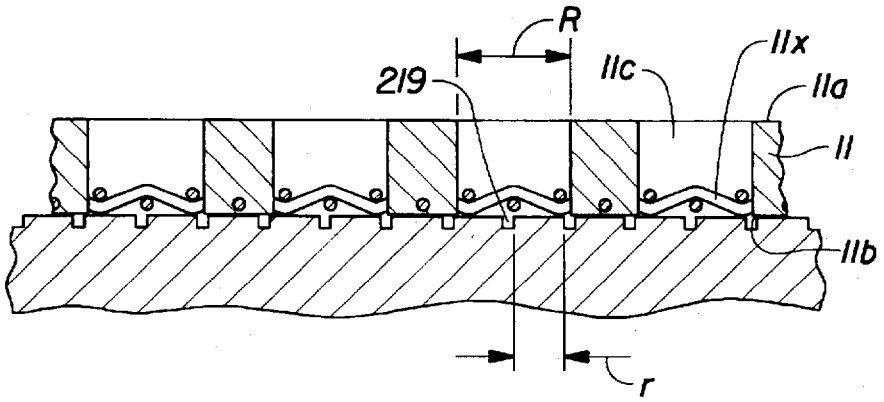
FIG. 5G is a schematic cross sectional view taken along line 5G—5G of FIG. 5F.

As has been pointed out hereabove, the vacuum apparatus of the present invention may be utilized with the papermaking belt 11 having a resinous framework (described in U.S. Pat. Nos. 4,529,480 and 4,637,859, mentioned hereabove and incorporated herein by reference). In this case, it is preferred that the cross-machine dimension of the sealing areas be less than that of a deflection conduit of the papermaking belt 10, as shown in FIGS. 5F and 5G. FIG. 5F and 5G show a combination of the papermaking belt 11 and the web-facing surface 214 having the textured area 215 therein. The textured area 215 has a plurality of sealing areas separated by the passageways 219. The belt 11 has a plurality of deflection conduits 11*c* extending between a web-contacting surface 11*a* and a backside surface 11*b* of the belt 11. It should be noted that the belt 11 may have a reinforcing structure 11*x* shown in FIG. 5G and not shown in FIG. 5F for clarity. In FIGS. 5F and 5G, the cross-machine dimension of the sealing areas is designated as "r"; and the cross-machine dimension of the deflection conduits 11*c* is designated as "R." As best shown in FIG. 5G, the cross-machine dimension "r" of the sealing areas is less than the cross-machine dimension "R" of the conduits 11*c* of the belt 11. Thus, the deflection conduits are not blocked by the sealing areas, and the papermaking web 27 traveling over the vacuum slot 216 is subjected to the vacuum pressure evenly distributed in the cross-machine direction.

Figure 7A:
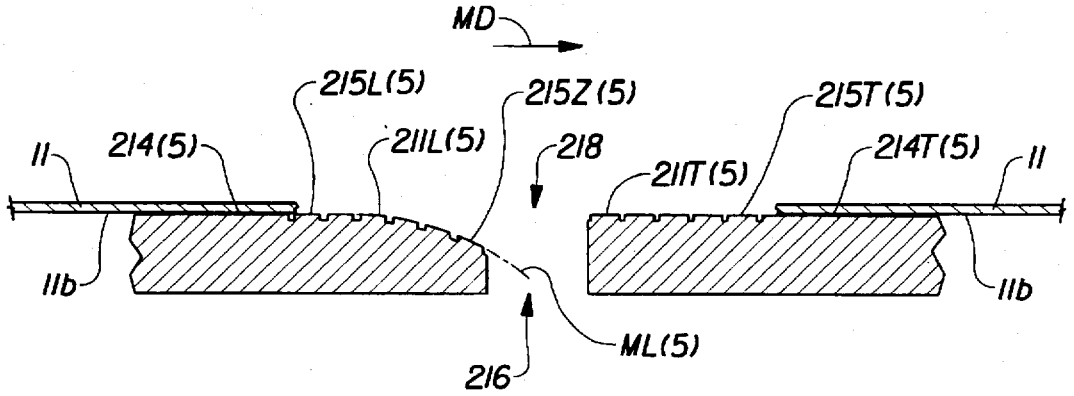
FIG. 7A is a simplified vertical sectional view of one embodiment of the textured surface shown in FIG. 6B.
Figure 7B:
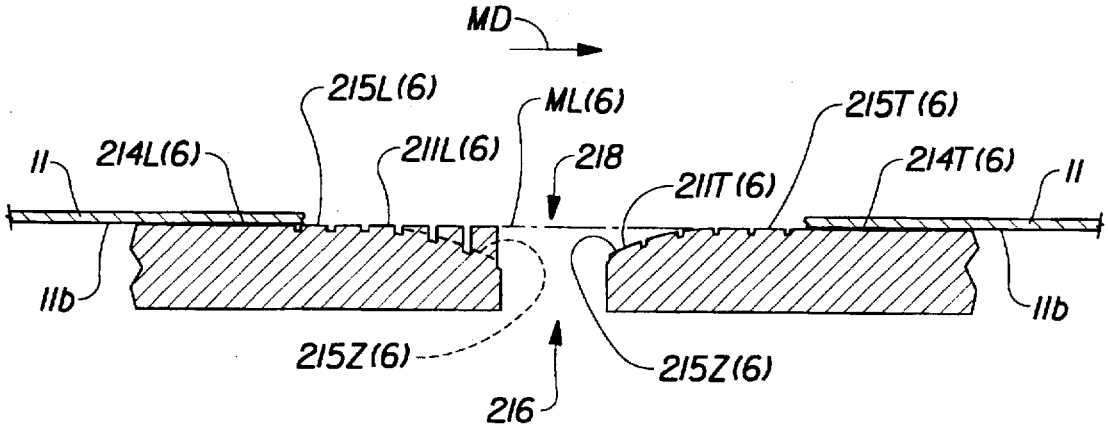
FIG. 7B is a simplified vertical sectional view of another embodiment of the textured surface shown in FIG. 6B.

As FIGS. 7A and 7B show, the textured area 215 of the web-facing surface 214 may have a transitional area 215Z in the region juxtaposed with the aperture 218. The transitional area 215Z(5) may be juxtaposed with the aperture 218 in the direction opposite the machine direction (i.e., be comprised of the leading textured area 215L(5)), as shown in FIG. 7A. Alternatively, the transitional area 215Z(6) may be juxtaposed with the aperture 218 in both directions: the machine direction and the direction opposite the machine direction (i.e., be comprised of both the leading textured area 215L(6) and the trailing textured area 215T(6)), as shown in FIG. 7B. In any case, the transitional area 215Z has a predetermined Z-directional spacing (or Z-spacing) from the backside surface 11*b* of the papermaking belt 11, which spacing continuously and gradually increases in the direction of the aperture 218. In other words, the Z-spacing associated with the leading textured surface 215L increases in the machine direction, and the Z-spacing associated with the trailing textured surface 215T increases in the direction opposite the machine direction. The Z-spacing may increase linearly. Alternatively, the Z-spacing may increase non-linearly, for example, exponentially.

As has been described hereabove, "texture" of the textured area 215 is created on the web-facing surface 214 by the discontinuities or interruptions that can comprise projections extending outwardly from the otherwise smooth surface or by depressions in such otherwise smooth surface. This "otherwise smooth surface" is an inherent surface of the web-facing surface 114, 214 of the vacuum apparatus 10, and may be either planar or non-planar, for example, curved. When the texture is created by projections extending outwardly from such inherent and otherwise smooth web-facing surface, the free ends of the projections may be viewed as defining another (imaginary) surface which is situated relatively "higher" (in the z-directional terms) than the inherent web-facing surface. When the texture is created by depressions in such inherent and otherwise smooth web-facing surface, the depth of the depressions may be viewed as defining a surface which is situated relatively "lower" (in the z-directional terms) than the inherent web-facing surface. In either case, the Z-spacing is measured from the "lowest" (in the z-directional terms) surface 215. That is to say, when the texture is created by projections extending from the inherent web-facing surface, the Z-spacing is measured from this inherent web-facing surface. When the texture is created by the depressions in the inherent web-facing surface, the Z-spacing is measured from the surface defined by the depth of the depressions.

The imaginary surface defined by the free ends of the projections 211L may conform to the rate of change of the Z-directional spacing, as shown in FIG. 7A: the cross-sectional profile of the line ML(5) defined by the free ends of the projections 211L(5) is substantially parallel to the cross-sectional profile of the inherent web-facing surface of the transitional area 215Z(5). Alternatively, as shown in FIG. 7B, the cross-sectional profile of the line ML(6) defined by the free ends of the projections 211L(6) is non-parallel to the cross-sectional profile of the inherent web-facing surface of the transitional area 215Z(6). Analogously, the surface defined by the depth of the depressions in the inherent web-facing surface also may or may not conform to the rate of change of the Z-spacing.

While not intended to be bound by theory, it is believed that the amount of vacuum pressure applied through the vacuum slot 216 to the papermaking belt 11 gradually increases due to the continuous and gradual increase of the Z-spacing Z between the transitional area 215Z and the backside 11*b* of the belt 11. In the embodiment shown in FIGS. 7A and 7B, two factors: the existence of the textured surface 215 and the continuous and gradual increase of the Z-spacing Z work together to mitigate the undesirable consequences of the sudden application of vacuum pressure to the web 27.

One skilled in the art will understand that while the examples of the particular embodiments of the textured surface (and the textured surface combined with the gradual increase of the Z-spacing) were disclosed with regard to the vacuum box 200 of the present invention, insofar as the present invention is concerned, they apply in all respects to the vacuum pick up shoe 100 of the present invention.

Figure 8:
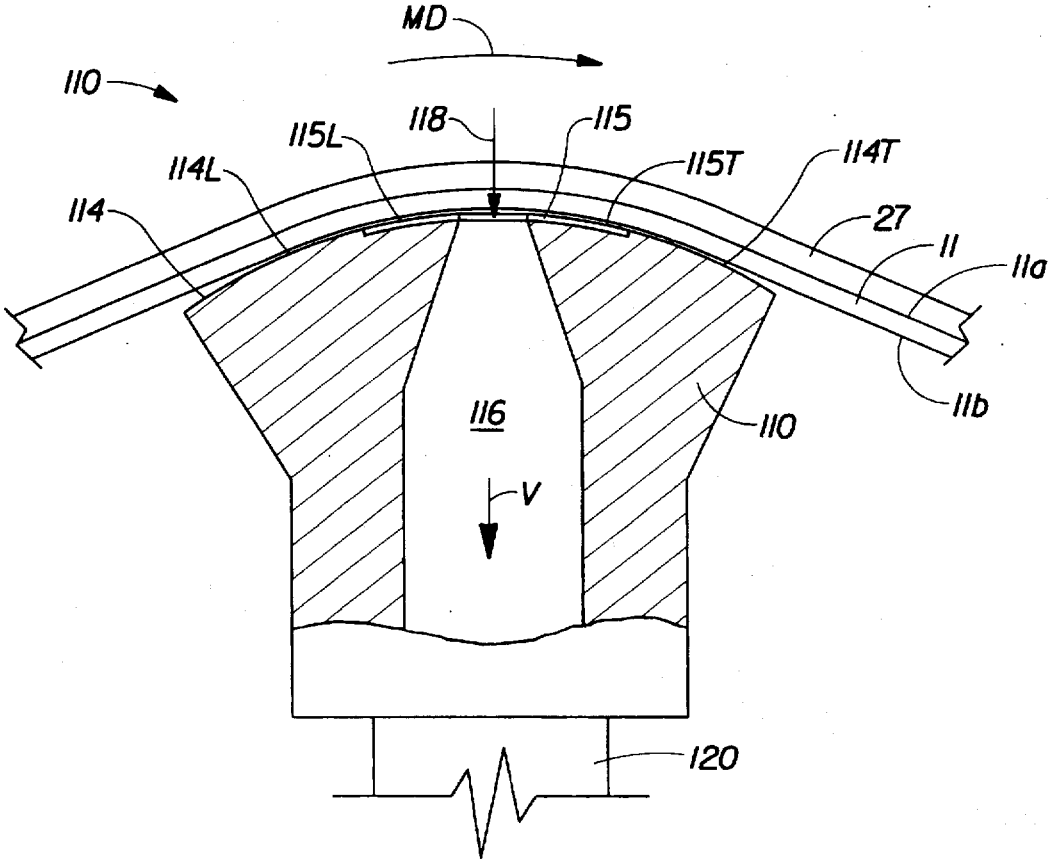
FIG. 8 is a schematic cross-sectional view of a pick-up shoe having a textured web-facing surface.

FIG. 8 schematically represents a fragment of the head 110 of the typical vacuum pick-up shoe 100 shown in FIG. 2. The head 110 has the web-facing surface 114 and at least one vacuum slot 116 disposed in the head 110 and defining the aperture 118 on the web-facing surface 114. The head 110 is joined to the body 120 which is in fluid communication with a vacuum source (not shown). The vacuum slot 116 is in fluid communication with the web-facing surface 114 and extends therefrom to the body 120. As FIG. 8 shows, the papermaking belt 11 carries the web 27 in the machine direction over the slot 116 (or over the aperture 118) of the vacuum pick-up shoe 100. The portion of the web-facing surface 114 includes the leading surface 114L, and the trailing surface 114T. A vacuum V is applied from a vacuum source (not shown), which exerts pressure on the belt 11 and the embryonic web 27 in the direction of the arrows V shown.

At least a part of the web-facing surface 114 has a textured area 115 which helps to eliminate the vacuum seal between the belt's smooth backside surface 11b and the web-facing surface 114. The textured area 115 comprises at least one leading textured area 115L. The textured area 115 may also comprise at least one trailing textured area 115T. The textured area 115 is juxtaposed with the aperture 118 and creates a leakage that does not allow a sudden application of vacuum pressure to occur when the paper web 27 is carried over the aperture 118. The leakage of at least about 35 Marlatts at pressure differential of 7 inches of Mercury is preferable. A conversion from Marlatts into standard cubic centimeters/minute can be made by inserting the reading measured in Marlatts into the following equation where x is the reading in Marlatts and y is the corresponding value in standard cc/minute:

$$y=36.085+52.583x-0.07685x^2.$$

This equation for converting Marlatts into standard cc/min. was developed by calibrating the flow meter to standard cc/min. using a Buck Optical Soap Bubble Meter. The commonly assigned and incorporated herein U.S. Pat. No. 5,334,289 describes in greater detail the test methods and a device utilized to conduct measurements of the leakage (U.S. Pat. No. 5,334,289, 65:8–68:7). The device described in U.S. Pat. No. 5,334,289 was utilized to measure the backside texture leakage of the papermaking belt. This device, with the following changes, can be utilized to measure a leakage of the textured surface 115, 215 of the vacuum apparatus 10 of the present invention. Referring to FIG. 30 of U.S. Pat. No. 5,334,289, a belt 10 having no backside leakage (i.e., a belt having the backside leakage of 0 Marlatts) is to be used for the test purposes of the present invention. This belt can be simulated for the control purposes by providing a piece of a flat material having the same hardness as that of the belt.

Further referring to FIG. 30 of U.S. Pat. No. 5.334,289, a surface of the plate 60, which is in direct contact with the belt 10, instead of being smooth, should comprise, or at least accurately simulate the particular textured area being tested. Such a plate may be made by machining a flat plate to have a surface texture identical to that of the texture under consideration, or may be made by positive and negative molds of the texture under consideration, as is done for orthodontia. Successive molds may be disposed adjacent each other and in proper orientation to obtain a sufficient plate size.

FIG. 8 shows the conventional vacuum pick up shoe 100 that has one vacuum slot 116 and one corresponding aperture 118. However, the vacuum pick up shoe 100 of the present invention may have more than one vacuum slot 116 and more than one aperture 118. These multiple vacuum slots 116 may have identical or non-identical configurations. The multiple vacuum slots 116 may have a common vacuum source and equal vacuum pressure. Alternatively, each vacuum slot 116 may have individual vacuum pressure different from the vacuum pressure of the other vacuum slot(s) 116. When the vacuum pick up shoe 100 having two or more vacuum slots 116 is used, each vacuum slot 116 may have its individual means of vacuum pressure control. Such devices as vacuum valves, well known in the art may be utilized as the means of individual vacuum pressure control.

Vacuum Apparatus Having Textured Clothing

Figure 9:
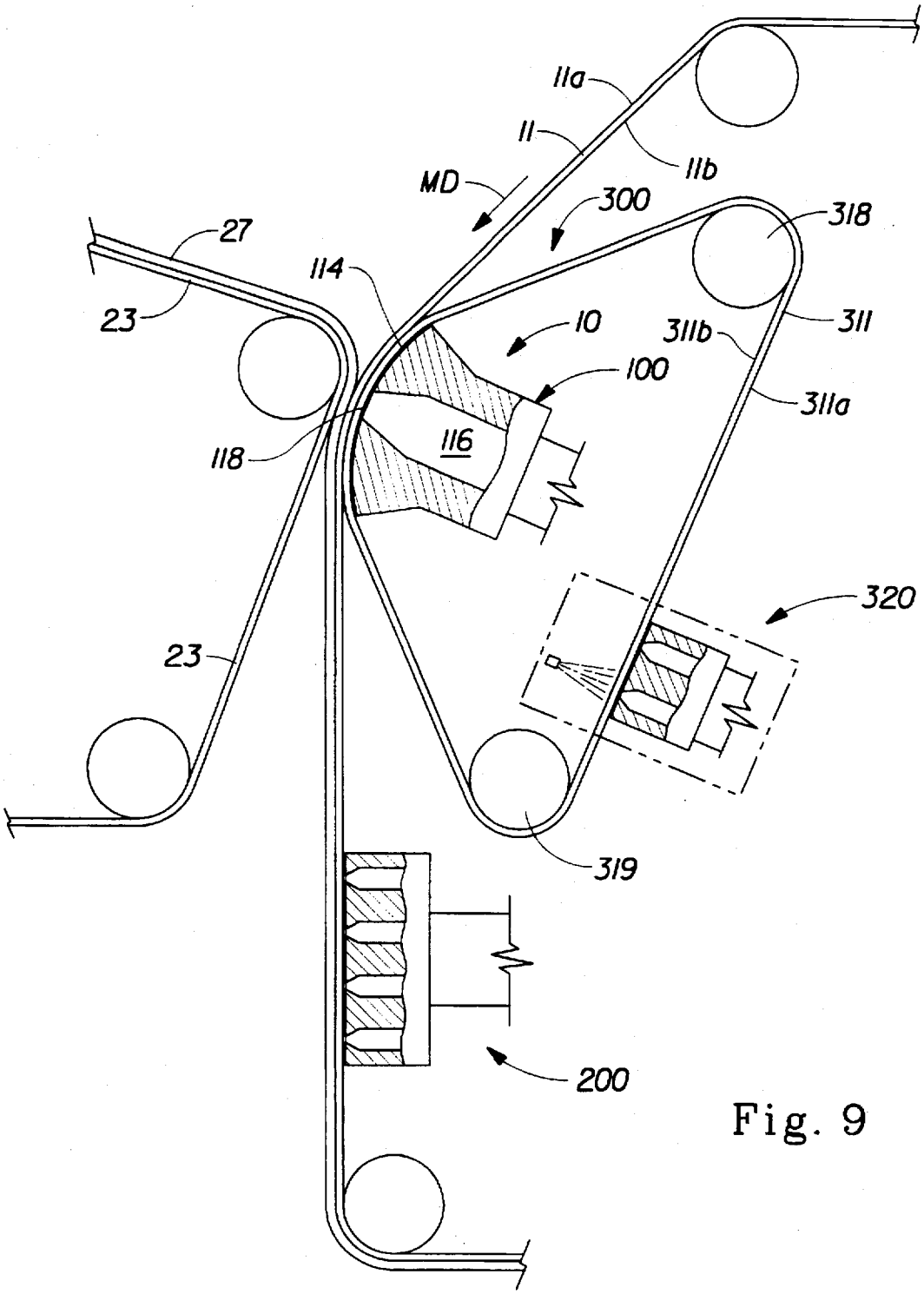
FIG. 9 is a fragmentary schematic side elevational view of a continuous papermaking process utilizing a vacuum apparatus of the present invention having a textured clothing in the form of an endless textured belt.

The process and apparatus shown in FIG. 9 includes a textured clothing 300 interposed between the web-facing surface 114 of the vacuum pick up shoe 100 and the backside surface 11b of the belt 11 carrying the paper web 27 thereupon. Preferably, the textured clothing 300 has a direct contact with the web-facing surface 114 of the pick up shoe 100. The textured clothing 300 creates a leakage of air between the web-facing surface 114 of the vacuum apparatus 10 and the backside surface 11b of the papermaking belt 11 and thus does not allow the vacuum seal to occur between these two surfaces. Although the textured clothing 300 of the preferred embodiment of the present invention is in the form of an endless textured belt 311, the clothing 300 can be incorporated into numerous other forms which include, for instance, stationary textured plates. In any case, preferably, the textured clothing 300 is adapted to move relative the web-facing surface 114 of the vacuum apparatus 10.

As shown in FIG. 9, the textured belt 311 has a web-facing surface 311a and a backside (or machine-facing) surface 311b. The web-facing surface 311a of the textured belt 311 is a surface of the belt 311 which contacts the backside 11b of the papermaking belt 11 carrying the paper web 27 to be dewatered and rearranged into the finished product. The opposed surface of the textured belt 311, the backside surface 311b, is the surface of the textured belt 311 which may travel over and is generally in contact with the web-facing surface 114 of the papermaking vacuum pick up shoe 100.

The belt 311 is said to be "textured" belt because it has surface texture irregularities. As used herein, the term "surface texture irregularities" (or simply "irregularities") refers to any discontinuity or non-planar interruptions in an ordinarily smooth or planar surface, such as projections from the plane of a smooth surface and/or depressions in such a surface. The irregularities may comprise those portions which constitute non-regular or uneven portions in the textured belt's backside surface 311b.

As FIG. 9 schematically illustrates, the textured belt 311 travels around the vacuum pick up shoe 100 and around return rolls 318 and 319. Preferably, the textured belt 311 travels in the direction of the papermaking belt 11 carrying the paper web 27 thereupon, or in the machine direction. More preferably, the textured belt 311 travels in the machine direction at the same speed as the papermaking belt 11. In this case, friction between the web-facing surface 311a of the textured belt 311 and the backside surface 11b of the papermaking belt 11 is minimal. At the same time, the textured belt 311 interposed between the papermaking belt 11 and the web-facing surface 114 eliminates friction between the papermaking belt 11 and the web-facing surface 114.

It is believed that elimination of friction between the papermaking belt 11 and the web-facing surface 114 will significantly increase life expectancy of the papermaking belt 11, and—as a result—the efficiency of the whole papermaking process. The failure of papermaking belts has serious implications on the efficiency of a papermaking processes. A high frequency of belt failures can substantially affect the economies of a paper manufacturing business due to a machine "downtime" periods. The significance of prolonging the life expectancy of the papermaking belt is increased by relatively high cost of the belts. In most cases, manufacturing a foraminous woven element (i.e., a reinforcing structure which is one of the primary elements of papermaking belts utilized in the drying through papermaking process of the present invention) requires expensive textile processing operations, including the use of large and costly looms. Also, substantial quantities of relatively expensive filaments are incorporated into these woven elements. The cost of the belts increases even further when high heat resistant filaments are employed, which is generally necessary for belts which pass through a drying operation.

While not preferred, the textured belt 311 may move at the speed which is greater or less than the speed of the papermaking belt 11. Also, while still not preferred, the textured belt 311 may travel in the direction opposite the machine direction. An arrangement is also possible in which the textured belt 311 is adapted to move in the cross-machine direction (not shown).

The textured belt 311 may be adapted to move periodically. As used herein, the term "periodic movement" defines a recurrent motion of the textured belt 311 during certain intervals of time. The periodic movement of the textured belt 311 can be beneficial for the purposes of cleaning the textured belt 311, because it allows more time (during the period when the textured belt 311 is not moving) to clean the a certain area or areas of the textured belt 311. The cleaning process will be described herebelow. Preferably, the textured belt 311 has a high permeability to fluids such as water and air. The preferred air permeability of the belt 311 is at least about 400 cubic feet per minute per square foot of its surface at a pressure differential of 100 Pascals. Any textured papermaking belt suitable for use in a through drying process may be utilized as a textured belt 311 in the present invention. U.S. Pat. Nos. 4,529,480; 4,514,345; 4,637,859; 5,334,289 disclosing the papermaking belts having a textured surface are incorporated by reference herein. The papermaking belts woven using a Jacquard mechanism or loom can also be utilized in the present invention.

Preferably, as shown in FIG. 9, the papermaking process utilizing the textured belt 311 of the present invention includes a cleaning station 320 for cleaning the textured belt 311. While traveling over the vacuum slot 116 of the vacuum pick up shoe 100, the textured belt 311 may accumulate mobile fibers which may pass through the papermaking belt 11 as a result of the application of the vacuum pressure. Thus, the textured clothing 311 not only mitigates the undesirable consequences of the sudden application of vacuum pressure to the paper web 27 by creating leakage, but also protects a vacuum apparatus 10 from accumulating the very mobile fibers which still may pass through the belt 11. Preferably, the cleaning station 320 of the present invention comprises at least one shower followed in the machine direction by a vacuum box. The shower washes the accumulated fibers out of the textured belt 311, and the vacuum box then dries the textured belt 311. The process of cleaning of the textured belt 311 is within the scope of well-developed technology and known to those skilled in the art.

Vacuum Apparatus Having Web-Facing Surface Comprising, Transitional Area

Figure 10A:
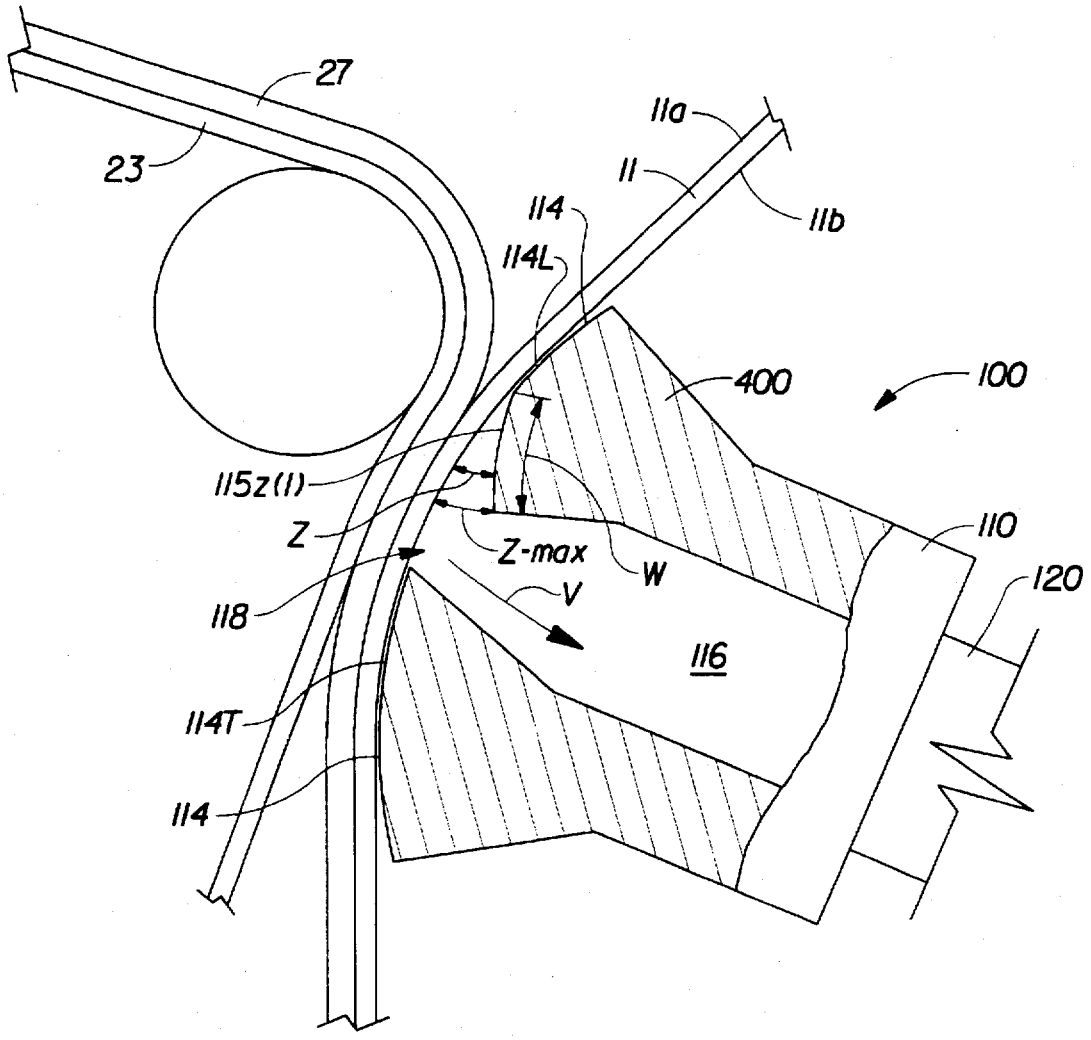
FIG. 10A is a schematic cross-sectional view of a vacuum apparatus of the present invention comprising a vacuum pick-up shoe having a transitional area with a predetermined Z-directional spacing continuously and gradually increasing in the machine direction and defined by an upper surface of a modular segment.

FIG. 10A shows the papermaking process at the point where the vacuum pick-up shoe 100 pulls the paper web 27 from the wire 23 to the papermaking belt 11 by utilizing the vacuum pressure V applied through the vacuum slot 116. Similar to FIG. 8, the head 110 has the web-facing surface 114 adapted to support the papermaking belt 11 carrying the paper web 27 thereupon, and at least one vacuum slot 116. The slot 116 defines the aperture 118 on the web-facing surface 114. The head 110 is joined to the body 120 which is in fluid communication with a vacuum source (not shown). The vacuum slot 116 is in fluid communication with the web-facing surface 114 and extends therefrom to the body 120. As FIG. 10A shows, the papermaking belt 11 carries the embryonic web 27 over the slot 116 in the machine direction indicated by the arrow MD. The portion of the web-facing surface 114 includes at least one leading surface 114L and at least one trailing surface 114T. The vacuum V is applied from a vacuum source (not shown), which applies additional pressure to the papermaking belt 11 and the embryonic web 27 in the direction of the arrow V shown.

As FIG. 10A shows, the leading surface 114L has a transitional area 115*z* juxtaposed with the aperture 118. The transitional area 115*z* has a predetermined Z-directional spacing (or Z-spacing) Z from the backside surface 11*b* of the belt 11, which spacing continuously and gradually increases in the machine direction as the belt 11 with the paper web 27 thereupon travels in the machine direction. While not intended to be bound by theory, it is believed that due to the existence of the transitional area 115*z*, the amount of vacuum pressure applied to the web 27 through the vacuum slot 116 gradually increases as the web 27 travels in the machine direction in front of the aperture 118. Thus, the continuous gradual increase of the Z-spacing Z between the transitional area 115*z* and the belt 11 does not allow the extremely sudden application of the vacuum pressure to occur when the paper web 27 is carried over the aperture 118.

The continuous gradual increase of the Z-spacing Z between the surface of the transitional area 115*z* and the backside 11*b* of the papermaking belt 11 may comprise a linear increase. Alternatively, the continuous gradual increase of the Z-spacing Z may comprise a non-linear increase, for example, an exponential increase in the Z-spacing Z. As used herein, by exponential increase of the Z-spacing it is meant that the Z-spacing is proportional to the function $F^x$ where x is greater than 1. The Z-spacing Z increases in the machine direction until it reaches its maximum Z-max.

For a typical commercial papermaking machine, the transitional area 115*z* has a length W of at least about 0.5 inch, and preferably at least about 1 inch. The length W is a geometrical length of the area 115*z* measured in the machine direction, i.e., the length W comprises a straight line if the transitional area 115*z* is a planar area, and the length W comprises a curved line if the transitional area 115*z* is a curved area, this curved line conforming the shape of the curve of the transitional area 115*z* in the machine direction. The transitional area 115*z* (215*z*) starts at the point where the papermaking belt 11 first permanently separates from the leading web-facing surface 114L (214L) due to the beginning of the increase of the Z-spacing, on any one cycle of the papermaking belt 11. It should be carefully noted that the transitional area 115*z* (215*z*) should not be construed to mean an area created by routine machining operations not intended for creating the transitional area, such as ordinary surface asperities or machining radii. Preferably the transitional area has an aspect ratio W:Z-max, taken as the ratio of the machine direction length of the transitional area 115*z* to the maximum Z-max spacing of the transitional area 115*z* of at least about 6:1, and preferably at least about 8:1.

Figure 10B:
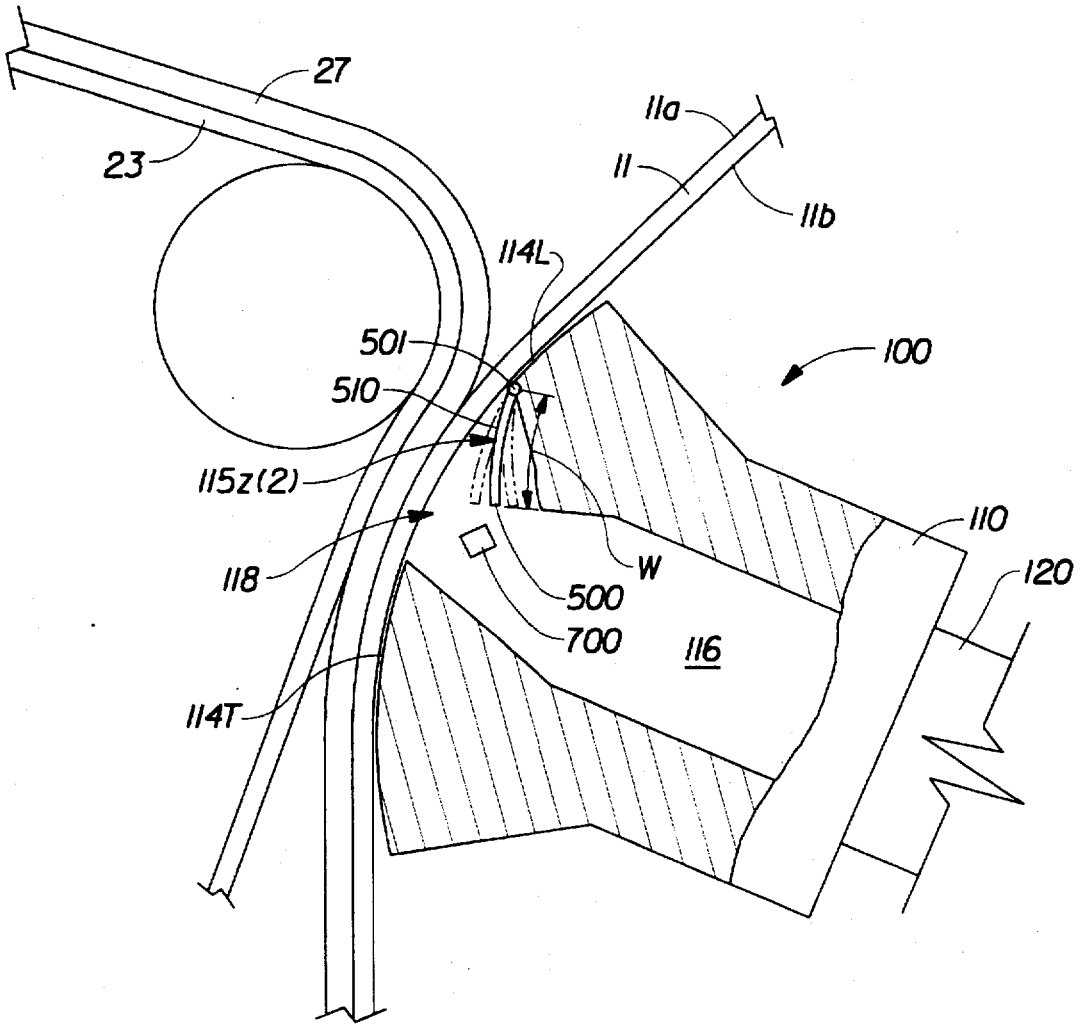
FIG. 10B is a schematic cross-sectional view of the vacuum apparatus of the present invention similar to FIG. 10A, having a transitional area defined by the upper surface of a rotatable element.
Figure 10C:
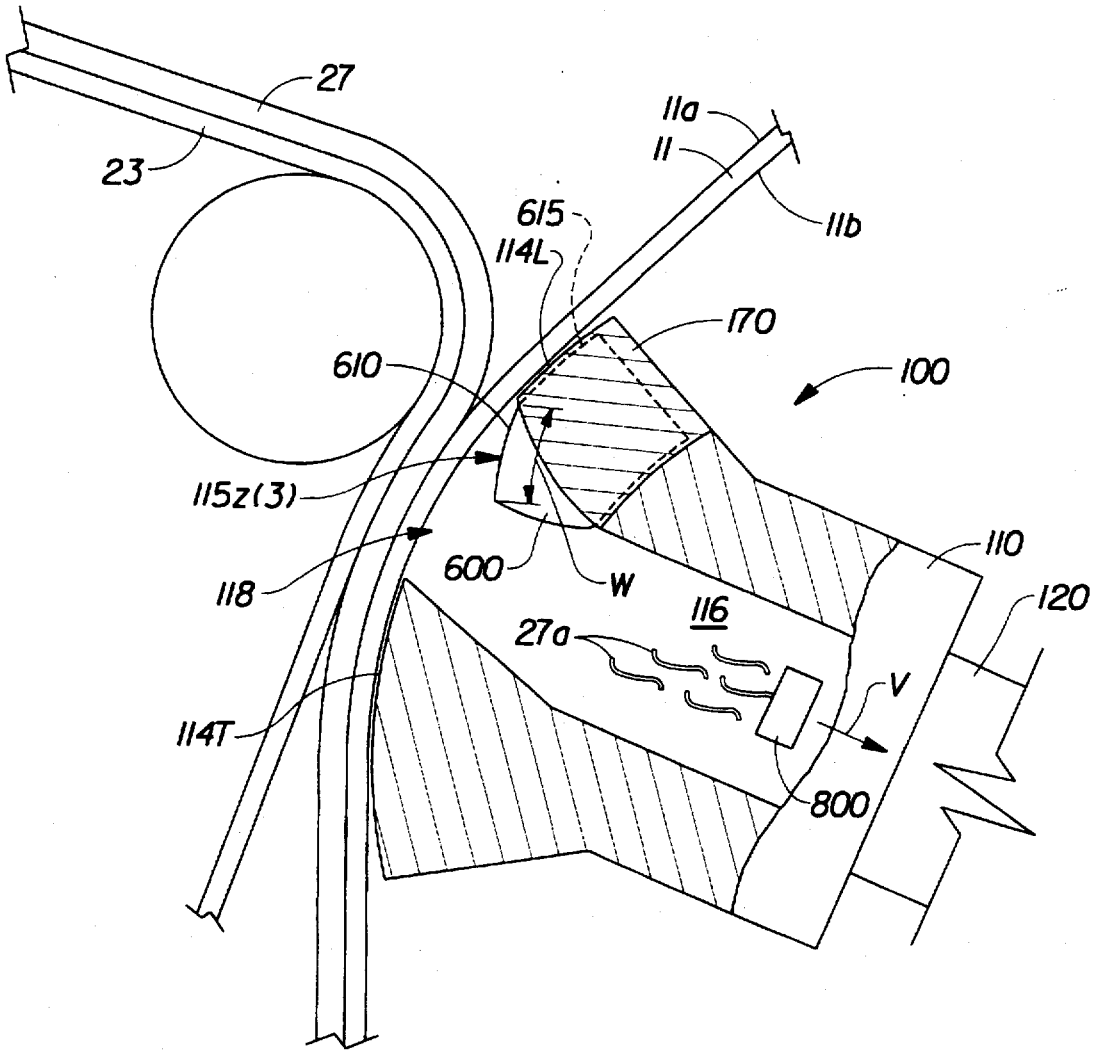
FIG. 10C is a schematic cross-sectional view of the vacuum apparatus of the present invention similar to FIGS. 10A and 10B, having a transitional area defined by the upper surface of a retractable device.

A means of adjusting the increase of the Z-spacing can be provided in the vacuum pick up shoe 100 of the present invention. The adjustable Z-spacing (or the adjustable position of the transitional area 115*z*) allows a greater flexibility in selecting the level of vacuum pressure applied to a paper web at a particular point during the papermaking process and without interrupting the process. FIGS. 10A through 10C show various embodiments having an adjustable Z-spacing.

FIG. 10A shows the embodiment of the vacuum pick up shoe 100 of the present invention, having the transitional area 115z(1) defined by an upper surface 410 of a modular segment 400. The modular segment 400 is adapted to be removed and replaced by another modular segment having a differently shaped upper surface 410 defining the transitional area 115z(1)—depending upon the particular conditions of a given papermaking process and the desired rate of the increase of the vacuum pressure in the region of the transitional area 115z.

FIG. 10B shows a fragment of another embodiment of the vacuum pick up shoe 100 of the present invention, having the transitional area 115z(2) defined by an upper surface 510 of a rotatable element 500. The rotatable element 500 is designed to be hingedly attached to the head 110 of the vacuum pick up shoe 100. The element 500 can articulate about a hinge 501 so as to effectively change the degree of increase of the Z-spacing. The exact position of the rotatable element 500 may be manually adjusted by an operator. Alternatively, the position of the rotatable element 500 may be automatically adjustable, depending upon the particular conditions of a given papermaking process and the desired properties of the paper being produced.

FIG. 10C shows still another embodiment of the adjustable transitional area 115z. As FIG. 10C shows, the transitional area 115z(3) is defined by an upper surface 610 of a retractable device 600. The retractable device 600 is slidably extendible from a housing 170 inside the head 110 and is capable of being fully or partially recessed in the housing 170. When not in use, the device 600 is retracted into the housing 170. When in use, the device 600 is extended from the housing 170 as far as required to provide the necessary transitional area 115z(3). It should be pointed out that the transitional area 115z may be defined by only a part of the upper surface 610. FIG. 10C shows that the retractable device 600 may have a part 615 of the upper surface 610 which conforms the shape of the non-transitional part of the web-facing surface 114, and thus does not define the transitional area 115z.

The rotatable element 500 and the retractable device 600 may be adjustable manually by an operator. Alternatively and prophetically, they may be automatically adjustable in response to a signal from a flow-measuring device 700, as shown in FIG. 10B with respect to the device 500. Such an option is within the ability of those skilled in the art. The flow-measuring device 700 measures the air flow over or close to the transitional area 115z(5). When the air flow is higher or lower than a certain pre-set level of the air flow pre-selected on the basis of the particular conditions of a given papermaking process and the desired qualities of the paper web being produced, the flow-measuring device 700 sends an error signal to adjust the device 600 or rotatable element 500 accordingly and thus—to reduce or to increase the air flow in the transitional area 115z.

Prophetically, the rotatable element 500 and the retractable device 600 may be automatically adjustable in response to a signal from a fiber-detecting system 800, as shown in FIG. 10C with respect to the device 600. A sensory fiber-detecting system 800 is capable of detecting free fibers 27a present in the air flow moving through the vacuum slot 116. When the number of detected free fibers 27a passing through the vacuum slot 116 is greater than a certain pre-selected threshold, the fiber-detecting system 800 sends an error signal to accordingly adjust (presumably, extend) the device 600 or rotatable element 500. The fiber-detecting system 800 may be utilized as an additional or alternative means to the flow-measuring device 700.

Vacuum Apparatus Having Flow Management Device

Figure 11:
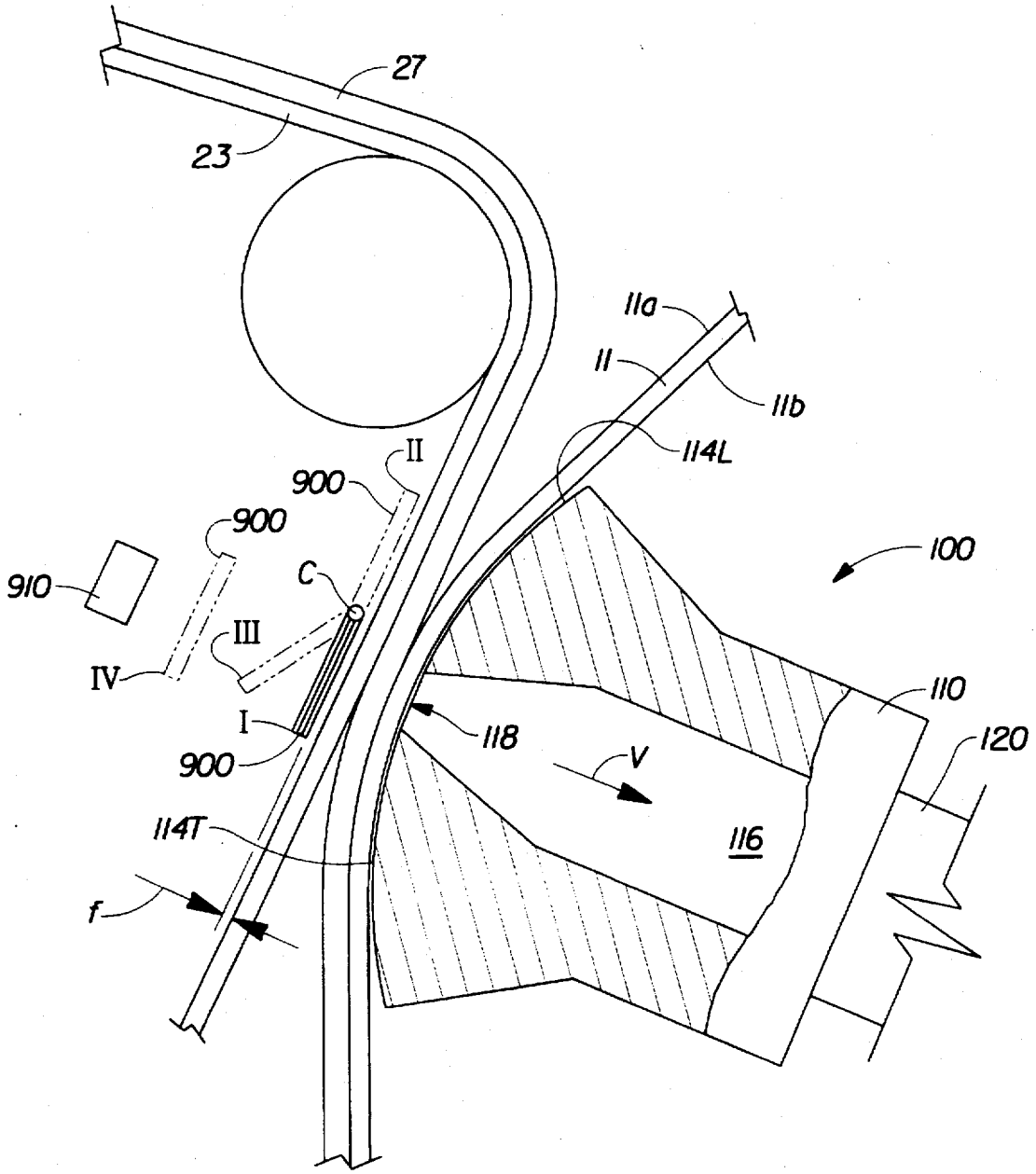
FIG. 11 is a schematic cross-sectional view of a vacuum apparatus of the present invention comprising a vacuum pick-up shoe and a flow management device.

FIG. 11 shows a vacuum pick up shoe having an external flow management device 900. FIG. 11 shows the papermaking process at the point where the vacuum pick-up shoe 100 pulls the paper web 27 from the wire 23 to the papermaking belt 11 by utilizing the vacuum pressure V applied through the vacuum slot 116. Similar to FIG. 8, and FIG. 10A, the head 110 has the web-facing surface 114 adapted to support the papermaking belt 11 carrying the paper web 27 thereupon, and at least one vacuum slot 116. The slot 116 has a predetermined length in the machine direction and defines the aperture 118 on the web-facing surface 114. The head 110 is joined to the body 120 which is in fluid communication with a vacuum source (not shown). The vacuum slot 116 is in fluid communication with the web-facing surface 114 and extends therefrom to the body 120. As FIG. 10A shows, the papermaking belt 11 carries the embryonic web 27 over the slot 116 in the machine direction indicated by the arrow MD. The portion of the web-facing surface 114 includes at least one leading surface 114L and at least one trailing surface 114T. The vacuum V is applied from a vacuum source (not shown), which applies additional pressure to the papermaking belt 11 and the embryonic web 27 in the direction of the arrow V shown.

According to the present invention, the flow management device 900 is disposed such that the papermaking belt 11 having the paper web 27 thereupon travels between the web-facing surface 114 of the vacuum pick up shoe 100 and the flow management device 900. The flow management device 900 faces the wire 23 and the web-contacting surface 11a of the papermaking belt 11. As FIG. 11 shows, the flow management device also faces the web-facing surface 114 of the vacuum pick up shoe 100 in the area of the aperture 118. The flow management device 900 has a certain flow resistance, and thus is adapted to control the distribution of the air flow through the aperture 118 of the vacuum slot 116. By controlling the distribution of this air flow, the flow management device 900 is able to control the amount of vacuum pressure applied through the vacuum slot 116 to the paper web 27. In accordance with the present invention, the amount of vacuum pressure applied through the vacuum slot 116 to the paper web 27 increases in the machine direction as the paper web 27 travels in the machine direction in front of the aperture 118 and between the web-facing surface 114 and the flow management device 900. Thus the vacuum slot 116 has different vacuum pressures through different positions spaced apart in the machine direction length of the vacuum slot 116.

The flow management device 900 may be made of any material having an air flow resistance. The examples may range from an air impermeable material, such as a board, to a specially woven wire having a certain projected open area for air flow to pass. The papermaking belts described in the commonly assigned U.S. Pat. No. 4,529,480, issued Jul. 16, 1985 to Trokhan; U.S. Pat. No. 4,637,859, issued Jan. 20, 1987 to Trokhan; and U.S. Pat. No. 5,334,289, issued Aug. 2, 1994 to Trokhan; may also be utilized as the flow management device 900 of the present invention.

The flow management device 900 shown in FIG. 11 may be stationary. Alternatively, the flow management device 900 may preferably be adapted to move in the machine direction and in the direction opposite the machine direction as schematically shown in phantom lines in FIG. 11 (positions (I) and (II), correspondingly). The flow management device may also be adapted to move in the direction perpendicular to the machine direction (FIG. 11, position (IV)). Also the embodiment possible in which the flow management device is adapted to pivotally rotate about a center of rotation "c," as schematically shown in FIG. 11 in phantom lines.

According to the present invention, the flow management device 900 can be spaced from the wire 23. FIG. 11 shows a distance "f" between the flow management device 900 and the wire 23. If the flow management devise 900 is stationary, the distance f is constant. One skilled in the art will readily understand that if the flow management device 900 is adapted to move in the direction opposite to the machine direction or to pivotally rotate around the center of rotation c, the distance f is changeable. Preferably the flow management device 900 is in direct contact with the wire 23.

A stationary flow management device 900 may be comprised of a plurality of segments successively spaced and adjacent to each other in the machine direction from a first segment to a last segment. Each of these segments may have a certain air flow resistance, or certain air permeability. Preferably the flow resistance of the flow management device decreases in the machine direction, such that the air permeability of the device 900 increases in the machine direction. Each of these individual segments may have the air permeability increasing in the machine direction. Each of these segments may comprise a screen having a mesh. One skilled in the art will readily understand that other embodiments of the segments may be utilized in the present invention.

Additionally, as schematically shown in FIG. 11, the flow management device 900 may include a fan 910 to intensify the air flow through the device 900 if desired.

Vacuum Apparatus Having Plurality Of Sequenced Vacuum Sections

Figure 12:
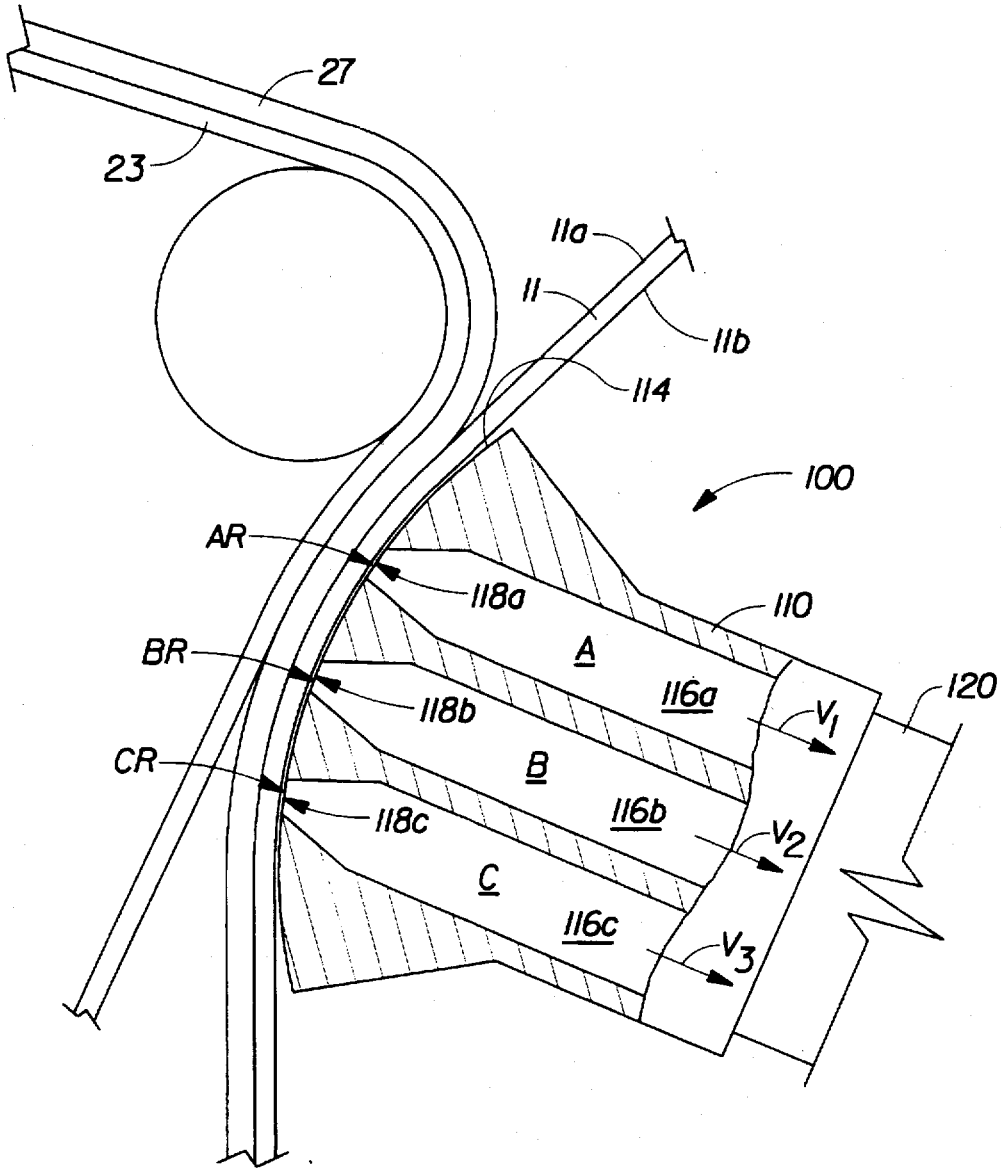
FIG. 12 is a schematic cross-sectional view of a vacuum apparatus comprising a pick up shoe having a plurality of sequenced vacuum sections successively spaced in the machine direction.

FIG. 12 shows a fragment of the papermaking process described hereabove at the point where the vacuum pick-up shoe 100 pulls the paper web 27 from the wire 23 to the papermaking belt 11 by utilizing vacuum pressure. Similar to FIGS. 8 and 10, the head 110 has the web-facing surface 114 adapted to support the papermaking belt 11 carrying the paper web 27 thereupon. As FIG. 12 shows, the vacuum pick up shoe 110 has a plurality of vacuum sections A, B, C successively spaced in the machine direction from a first vacuum section A to a last vacuum section C. Each vacuum section A, B, C comprises at least one vacuum slot 116. As used herein, the generic numeral reference 116 designates any vacuum slot disposed in the head 110 of the vacuum pick up shoe 100, and the generic numeral reference 118 designates any aperture defined by the vacuum slot 116 on the web-facing surface 114 of the vacuum pick up shoe 100. By analogy, the generic numeral reference 216 designates any vacuum slot disposed in the head 210 of the vacuum box 200, and the generic numeral reference 218 designates any aperture defined by the vacuum slot 216 on the web-facing surface 214 of the vacuum box 200.

Each vacuum section A, B, C has an associated resulting open area R (AR, BR, CR, respectively) on the web-facing surface 114, and vacuum V applied therethrough (V1, V2, V3, respectively). In the embodiment of the vacuum pick up shoe 100 shown in FIG. 12, vacuum section A comprises vacuum slot 116*a*, vacuum section B comprises vacuum slot 116*b*, and vacuum section C comprises vacuum slot 116*c*. Each vacuum slot 116 (116*a*, 116*b*, 116*c*) defines the aperture 118 (118*a*, 118*b*, 118*c*, respectively) on the web-facing surface 114, through which vacuum is applied to the belt 11. In the case where each vacuum section A, B, C comprises the single vacuum slot 116, as shown in FIG. 12, the resulting open area AR, BR, CR of each vacuum section A, B, C is the area of the corresponding aperture 118 defined by each individual vacuum slot 116 on the web-facing surface 114. Each vacuum section A, B, C is in fluid communication with the web-facing surface 114 and extends therefrom to the body 120. The body 120 is in further fluid communication with a vacuum source (not shown) through the vacuum sections A, B, C.

The vacuum applied to the papermaking belt 11 having the web 27 thereupon increases from the first vacuum section A having the vacuum V1 applied therethrough to the adjacent vacuum section B successively spaced next in the machine direction and having the vacuum V2 applied therethrough, and further to the next vacuum section C successively spaced in the machine direction and having the vacuum V3 applied therethrough. While not intended to be bound by theory, it is believed that this increase of vacuum in the machine direction mitigates the undesirable consequences of the sudden application of the vacuum pressure when the paper web 27 is being carried over the vacuum sections A, B, C in the machine direction. Preferably, the vacuum V1 is between about 5% and about 15% of the vacuum V3, and the vacuum V2 is between about 25% and about 35% of the vacuum V3.

It is believed that the transfer of the web from the forming wire to the papermaking belt occurs due to the initial deflection of the fibers into the deflection conduits of the papermaking belt. In the vacuum pick up shoes of the prior art having a single vacuum slot, the transfer/deflection process and the dewatering process occur almost simultaneously. The vacuum pick up shoe of the present invention allows one to decouple the process of transfer/deflection of the fibers into the deflection conduits of the paper making belt and the process of the initial dewatering of the web on the pick up shoe.

In the vacuum pick up shoe of the present invention shown in FIG. 12, a plurality of vacuum sections A, B, C defines at least two zones: an initial dewatering zone and a transfer zone. As used herein, the term "initial dewatering zone" indicates an area over the web-facing surface 114, having an associated "initial dewatering vacuum." As used herein, the term "transfer zone" indicates an area over the web-facing surface 114, having an associated vacuum pressure which is necessary to transfer the web 27 from the forming wire 23 to the papermaking belt 11. This vacuum pressure necessary for transferal to occur is a "transfer vacuum." Preferably, the initial dewatering vacuum is less than the transfer vacuum, i.e., the initial dewatering vacuum is less than that necessary for the transfer/deflection to occur. One skilled in the art will readily understand that the air flow associated with the transfer zone may intermingle with the air flow associated with the dewatering vacuum, due to relatively small distances between the apertures 118 defined by the vacuum slots 116 on the web-facing surface 114 and possible lateral leakage through the papermaking belt 11 and between the belt's backside 11*b* and the web-facing surface 114. While the air flows associated with the transfer zone and the dewatering zone may not have strict borders between them, the transfer zone and the dewatering zone are well defined in terms of the main function each of them perform and their relative sequence. In this regard, it should be noted that the transferal of the web 27 from the forming wire 23 to the papermaking belt 11 caused by the application of the transfer vacuum V2 also causes dewatering of the web 27.

To accomplish the process of transferring the web 27 from the forming wire 23 to the papermaking belt 11, a sufficient differential fluid pressure induced by the vacuum pick up shoe is applied to the web 27. Referring again to FIG. 12, preferably, the transfer of the web 27 starts at the point where the vacuum V2 is applied to the web 27. In this case, the vacuum V2 is the transfer vacuum, which is sufficient to cause the web 27 to transfer from the wire 27 to the belt 11 and to deflect at least some of the fibers into the deflection conduits of the papermaking belt 11. According to the present invention, it is preferred that the transfer vacuum V2 is preceded by the initial dewatering vacuum V1, as shown in FIG. 12. The initial dewatering vacuum V1 is not great enough to cause the fibers of the web 27 to deflect into the deflection conduits of the belt 11 as for the transfer to occur. However, this initial dewatering vacuum V1 is sufficient to cause the process of dewatering of the belt 11 to begin.

While FIG. 12 shows the vacuum sections A, B, C, each comprising one vacuum slot 116, each vacuum section may comprise two or more vacuum slots 116. In the case where each vacuum section A, B, C comprises more than one vacuum slot 116, the resulting open area R of each vacuum section A, B, C is comprised of the total of the areas of apertures 118 defined by the each section's individual vacuum slots 116 on the web-facing surface 114. It will be readily apparent to one skilled in the art that the number of vacuum sections used in the vacuum apparatus 10 of the present invention may differ from the number of the vacuum sections shown in FIG. 12. For example, the vacuum apparatus 10 may comprise two, four, five, . . . , N vacuum sections. Regardless of the number of the vacuum sections, preferably, the transfer zone is preceded, in the machine direction, by the initial dewatering zone, and the transfer vacuum is preferably greater than the initial dewatering vacuum.

The water removal, or dewatering, of the web through the initial dewatering zone and the transfer zone results in a decrease in fiber mobility in the paper web. This decrease in fiber mobility tends to fix the fibers in place after they have been deflected and rearranged. An additional dewatering zone may follow in the machine direction the transfer zone. Such an additional dewatering zone having an additional dewatering vacuum equal to or, preferably, greater than transfer vacuum V2 will continue the dewatering process after the web 27 has been transferred onto the belt 11. Such an additional dewatering zone may comprise one or more vacuum slots 116 having an associated vacuum V3, as shown in FIG. 12. The application of this vacuum pressure V3 causes further dewatering of the fibers, which at this point, have already been deflected into the deflection conduits, rearranged and lost most of their mobility. Because the papermaking fibers lost most of their mobility after the application of the vacuums V1 and V2, the successive vacuum V3 can be greater than the transfer vacuum V2, thus effectively increasing the drying capability of the vacuum pick up shoe.

The resulting open areas AR, BR, CR, . . . , NR successively spaced in the machine direction may be equal to each other. Alternatively, the resulting open areas AR, BR, CR, . . . , NR may increase in the machine direction from the first vacuum section resulting open area AR to the last vacuum section resulting open area NR, where the symbol "A" designates the first vacuum section, and the symbol "N" designates the last vacuum section. Each individual vacuum applied through each resulting open area may be controlled by a vacuum valve or another means of vacuum control. Screens having different degree of a flow resistance may also be provided in addition to vacuum valves, or as an alternative means of vacuum control.

Figure 13A:
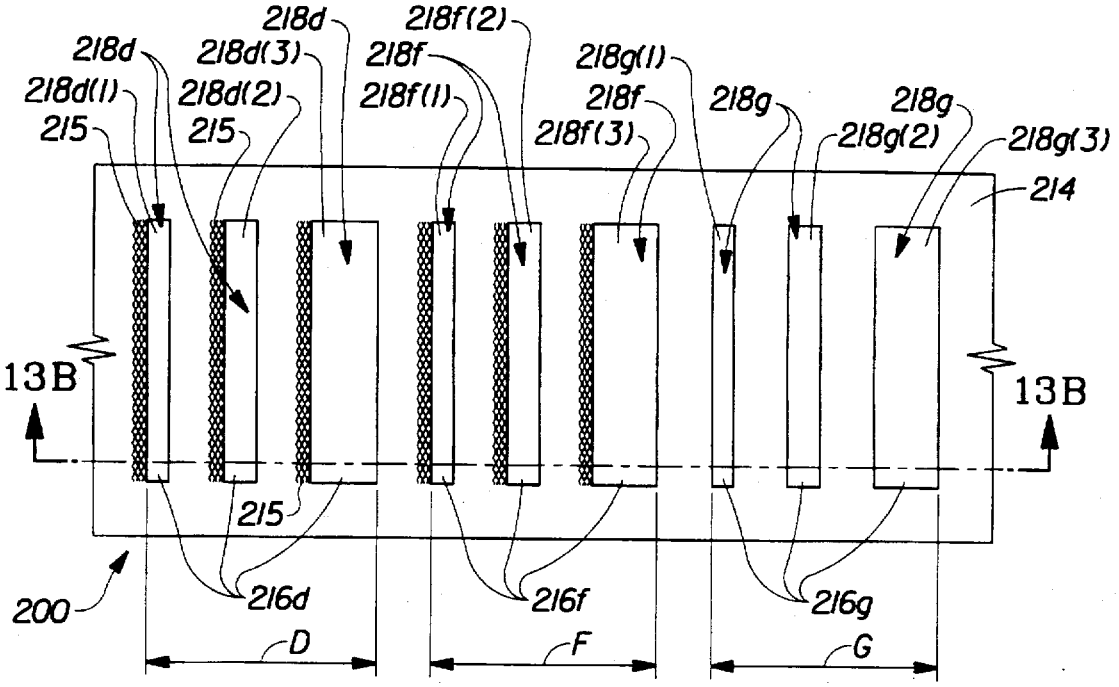
FIG. 13A is a schematic top plan view of a vacuum box having three vacuum sections, each vacuum section comprising three vacuum slots.

FIG. 13A schematically shows the plan view of the vacuum box 200 having three vacuum section D, F, G, each vacuum section comprising three vacuum slots 216 (216*d*, 216*f*, 216*g*, respectively). Within each vacuum section D, F, G, the vacuum slots 216 are successively spaced apart in the machine direction from a first vacuum slot 216*d*(1), 216*f*(1), 216*g*(1) to a last vacuum slot 216*d*(3), 216*f*(3), 216*g*(3), respectively. Each vacuum slot 216 defines the corresponding aperture 218 on the web-facing surface 114. The resulting open area of each vacuum section comprises the sum of the areas of the apertures 218 defined by the vacuum slots 216 within each vacuum section. Thus, a resulting open area DR of the vacuum section D is comprised of the sum of the areas of apertures 218*d* defined by the vacuum slots 216*d* on the web-facing surface 214 (i.e., the sum 218*d*(1)+218*d*(2)+218*d*(3)). A resulting open area FR of the vacuum section F is comprised of the sum of the areas of apertures 218*f* defined by the vacuum slots 216*f*, and so on. The vacuum slots 216 comprising any one vacuum section D, F, or G need not have the equal areas of apertures 218 defined by the slots 216 on the web-facing surface 214. Preferably, within the parameters of each vacuum section, the areas of the apertures 218 defined by the vacuum slots 216 on the web-facing surface 214 increase in the machine direction. Alternatively, the areas at the apertures 218 may be equal or even gradually decrease in the machine direction within the parameters of each vacuum section.

Figure 13B:
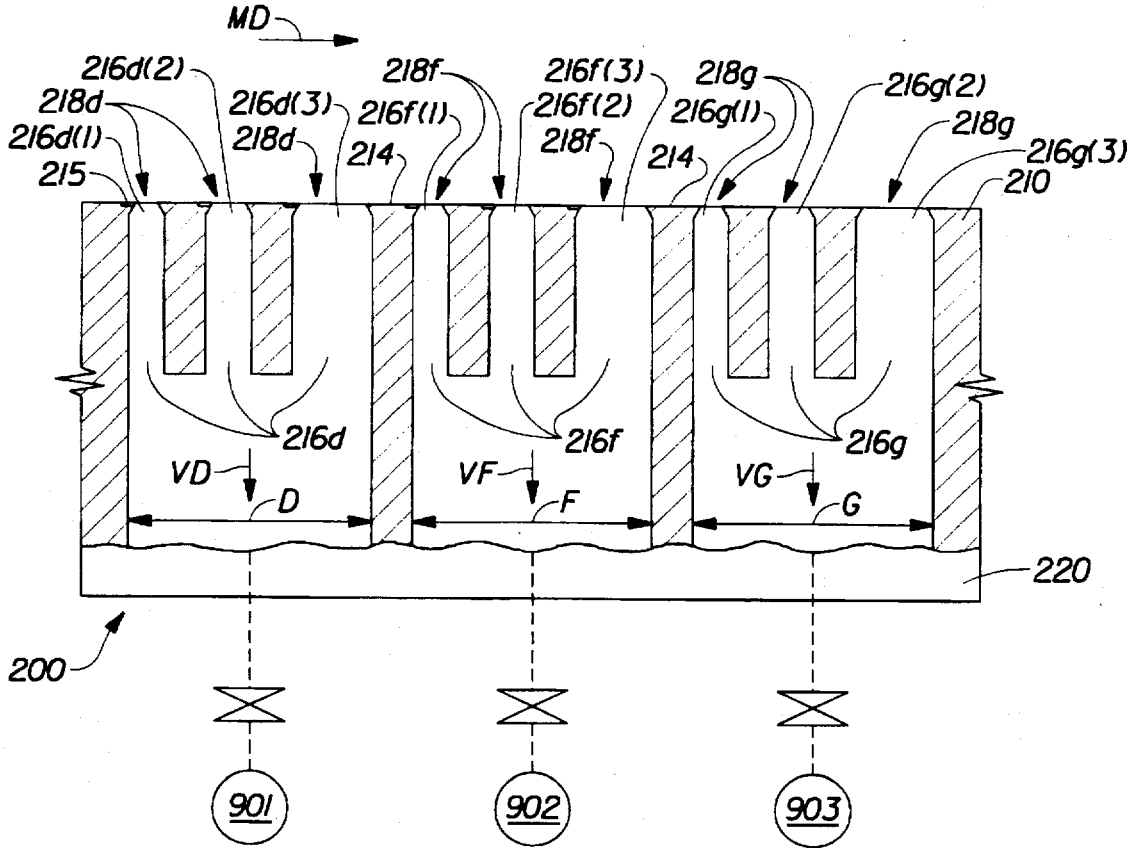
FIG. 13B is a vertical sectional view of a vacuum box shown in FIG. 12A, taken along lines 13B—13B.

FIG. 13B shows a cross-section of the vacuum box 200 shown in FIG. 13A. As FIG. 13A shows, the vacuum box 200 has three vacuum sections: a first vacuum section D, an intermediate vacuum section F, a last vacuum section G. The vacuum sections D, F, G are successively spaced in the machine direction, each vacuum section having three vacuum slots 216. Each vacuum slot 216 defines the aperture 218 on the web-facing surface 214 of the vacuum box 200. In FIG. 13B, the arrows VD, VF, VG indicate the amounts of vacuum pressure applied through the vacuum sections D, F, G, respectively, to the paper web 27 (not shown) disposed on the papermaking belt 11 (not shown). As has been disclosed hereabove, the vacuum VG applied through the vacuum section G is greater than the vacuum VF applied through the vacuum slot F, and the vacuum VF applied through the vacuum slot F is greater that the vacuum VD applied through the vacuum slot D. Preferably, the vacuum VD is between about 5% and about 15% of the vacuum VG, and the vacuum VF is between about 25% and about 35% of the vacuum VG.

While not intended to be bound by theory, it is believed that even the most mobile fibers lose much of their mobility by the time they reach the last vacuum section G, due to an incremental building up of the vacuum. Therefore, it is believed that the ultimate vacuum pressure V3 applied to the web 27 when it reaches the last vacuum section G can be significantly higher than the vacuum pressure used in the vacuum apparatuses of prior art having even (non-incremental) distribution of vacuum pressure.

When the vacuum apparatus 10 of the present invention comprises the plurality of sequenced in the machine direction vacuum sections, each vacuum section having the resulting open area and the vacuum applied therethrough, preferably, the vacuum applied through any successive resulting open area is at at least about 20% greater than the vacuum applied through the preceding resulting open area. As used herein, the term "successive" designates an element spaced in the machine direction next from another element of the same nature which is designated by the term "preceding." (Examples of the elements of the same nature include: vacuum sections, vacuum slots, resulting open areas, apertures.) In other words, starting with the second sequenced in the machine direction vacuum section, each vacuum is at least about 20% greater than the preceding vacuum.

One skilled in the art will readily understand that in the vacuum apparatus 10 of the present invention having a plurality of vacuum sections, each vacuum section need not have a plurality of vacuum slots. Thus, for example, the vacuum apparatus 10 having three vacuum sections may have only one vacuum section comprising a plurality of vacuum slots, while each of the two other vacuum sections comprise only one vacuum slot.

As FIGS. 13A and 13B show, the areas of apertures 218 defined on the web-facing surface 214 within the parameters of each individual vacuum section D, F, G increase successively in the machine direction. As has been shown hereabove, the vacuum increases from the first vacuum section D to the last vacuum section F. In addition, the vacuum may increase within each individual vacuum section D, F, G from the first aperture 218*d*(1) (or the first vacuum slot 216*d*(1), for this purpose) to the last aperture 218*d*(3) (or the last vacuum slot 216*d*(3)) within the vacuum section D; from the first aperture 218*f*(1) to the last aperture 218*f*(3) within the vacuum vacuum slot 216*d*(1), 216*f*(1), 216*g*(1) to a last vacuum slot 216*d*(3), 216*f*(3), section F; and from the first aperture 218*g*(1) to the last aperture 218*g*(3) within the vacuum section G. The increase of vacuum within each vacuum section can be achieved by successively increasing the areas of the apertures 218 in the machine direction within each vacuum section, as shown in FIGS. 13A and 13B, or by providing the apertures with grates, successively increasing projected open areas created by the grates (not shown) and thus—the air permeability of the grates. Alternatively, the increase of vacuum within each vacuum section from one vacuum slot to the next vacuum slot successively spaced in the machine direction may be achieved by providing each vacuum slot with individual means of vacuum control, such as vacuum valves. In any case, preferably, the vacuum applied through any successive vacuum slot is at least about 20% greater than the vacuum applied through the preceding vacuum slot within each vacuum section. It is believed that the increase of the vacuum from the first vacuum section to the last vacuum section in the machine direction, while increasing, at the same time, the vacuum within each vacuum section from the first vacuum slot to the last vacuum slot in the machine direction, provides more incremental general increase of the vacuum during the drying process and thus—improves the quality of the entire papermaking process.

The increase of vacuum pressure from the first vacuum section D to the last vacuum section G may be accomplished by any means well known in the art, for example, by vacuum valves if all vacuum sections D, F, G have the same vacuum source. Alternatively, each vacuum section may have its individual vacuum source. FIG. 13B shows the embodiment where each vacuum section D, F, G has its own individual vacuum source 901, 902, 903, respectively.

Figure 13C:
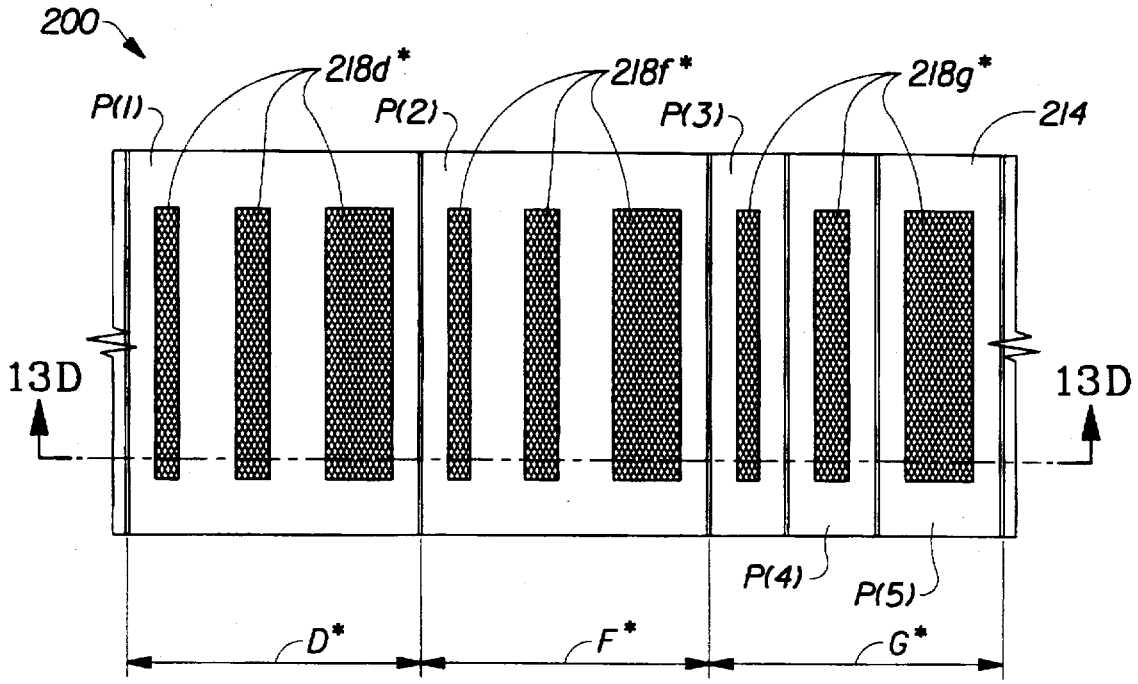
FIG. 13C is a schematic plan view of a vacuum box having vacuum sections comprising section covers.
Figure 13D:
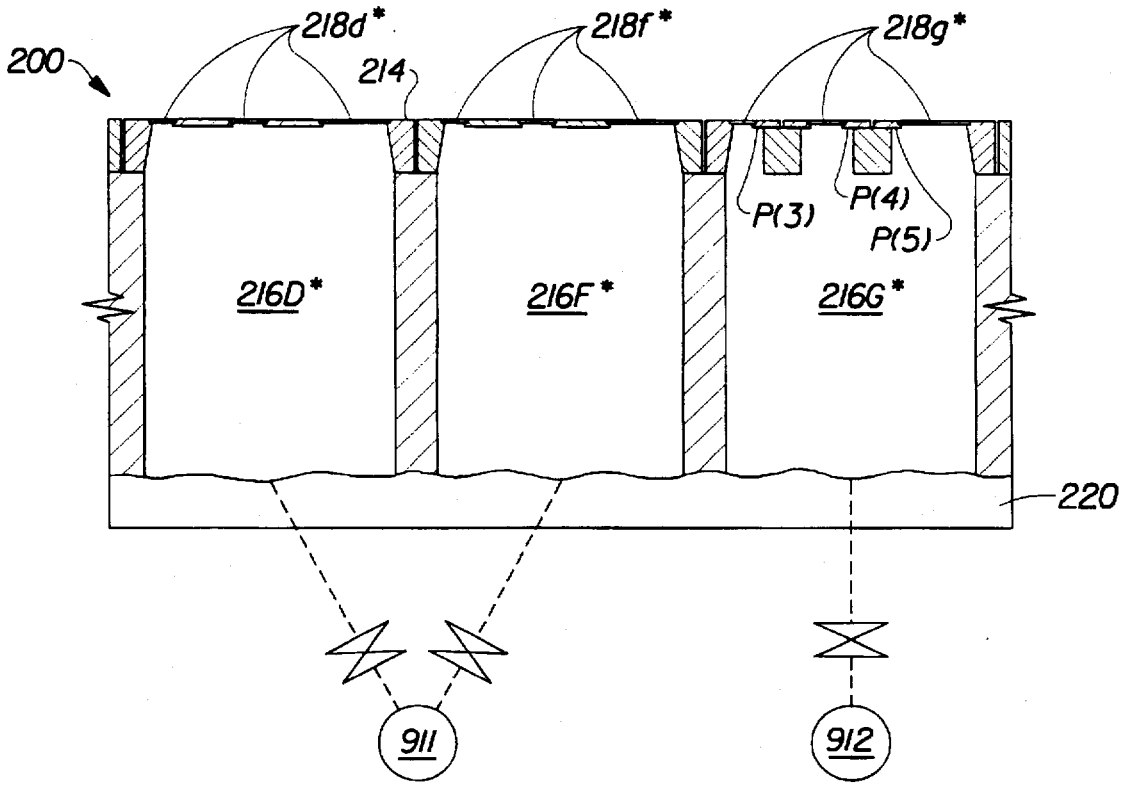
FIG. 13D is a vertical sectional view of the vacuum box shown in FIG. 12C, taken along lines 13D—13D.

FIG. 13C and 13D show another embodiment of the vacuum apparatus 10 of the present invention. In FIGS. 13C and 13D, the plurality of the sequenced vacuum sections D*, F*, G* is comprised of a plurality of correspondingly sequenced in the machine direction and adjacent to each other screens P, having different degree of a flow resistance. The plurality of screens P defines the web-facing surface 214. As an example, FIGS. 13C and 13D show that each vacuum section 216D*, 216F* has a single corresponding movable screen P(1), P(2), respectively. At the same time, a vacuum section 216G* has three movable screens P(3), P(4), P(5). Another variation of the embodiment of the vacuum box having movable screens is the vacuum box 200 having a single screen "covering" two or more vacuum sections (not shown). The apertures 218 may be provided with modular grates 218*d, 218*f, 218*g having certain projected open areas. The use of modular grates with different projected open areas allows to effectively change the projected areas of the apertures 218** and thus, the resulting open areas of the vacuum sections D*, F*, G* by simply changing the modular grates 218*d, 218*f, 218*g**.

The vacuum apparatus 10, shown in FIGS. 12, 13A, 13B, 13C, 13D may have the web-facing surface 114, 214 comprising the textured area 115, 215, respectively. As has been described hereabove, the textured area 115, 215 of the web-facing surface 114, 214 creates leakage in the area where the web-facing surface 114, 214 is juxtaposed with the apertures 118, 218 defined by the vacuum slots 116, 216 on the web-facing surface 114, 214. The use of the textured area 114, 215 even further helps to avoid the undesirable consequences of the sudden application of vacuum pressure described hereabove. Alternatively, the textured clothing interposed between the web-facing surface 114, 214 and the papermaking belt 11 (not shown) and disclosed hereabove may be utilized to create leakage.

What is claimed is:

1. A vacuum apparatus in a papermaking machine having a machine direction and a cross-machine direction perpendicular to said machine direction, said apparatus comprising:

a head having a web-facing surface supporting a papermaking belt traveling in said machine direction;

a body joined to said head and being in fluid communication with a vacuum source;

at least one vacuum slot disposed in said head and defining an aperture on said web-facing surface, said at least one vacuum slot extending from said web-facing surface to said body;

said web-facing surface having a textured area in the region juxtaposed with said aperture, said textured area comprising a plurality of sealing areas which are discrete relative to each other in both said machine direction and said cross-machine direction, said sealing areas being separated from one another by a continuous reticulated network of passageways extending in at least two mutually intersecting directions and being in fluid communication with said at least one vacuum slot, to provide a leakage between said web-facing surface and the papermaking belt.

2. The apparatus of claim 1, wherein said web-facing surface is planar.

3. The apparatus of claim 1, wherein said web-facing surface is non-planar.

4. The apparatus according to claim 1, wherein said apparatus comprises a vacuum pick-up shoe.

5. The apparatus according to claim 1, wherein said apparatus comprises a vacuum box.

6. The apparatus according to claim 1, wherein said sealing areas comprise a non-random repeating pattern.

7. The apparatus according to claim 6, wherein said non-random repeating pattern comprises a bilaterally staggered array.

8. The apparatus according to claim 1, wherein said textured area of said web-facing surface has a transitional area in the region juxtaposed with said aperture, said transitional area having a predetermined Z-spacing from the papermaking belt, said Z-spacing increasing in the machine direction.

9. The apparatus according to claim 8, wherein said Z-spacing increases linearly.

10. The apparatus according to claim 8, wherein said Z-spacing increases exponentially.

11. A vacuum apparatus in a papermaking machine having a machine direction and a cross-machine direction perpendicular to said machine direction, said apparatus comprising:

a head having a web-facing surface supporting a papermaking belt traveling in the machine direction, said web-facing surface comprising at least one leading surface and at least one trailing surface;

a body joined to said head and being in fluid communication with a vacuum source;

at least one vacuum slot disposed in said head and defining an aperture on said web-facing surface between said leading surface and said trailing surface, said at least one vacuum slot extending from said web-facing surface to said body;

said at least one leading surface having a textured area in the region juxtaposed with said aperture, said textured area comprising a plurality of sealing areas which are discrete relative to each other in both said machine direction and said cross-machine direction, and a continuous reticulated network of passageways extending in at least two mutually intersecting directions and separating said sealing areas from one another, said passageways being in fluid communication with said at least one vacuum slot, to provide a leakage between said at least one leading surface and the papermaking belt.

12. A vacuum apparatus in a papermaking machine having a machine direction and a cross-machine direction perpendicular to said machine direction, said apparatus comprising:

a head having a web-facing surface supporting a papermaking belt traveling in the machine direction, said web-facing surface comprising at least one leading surface and at least one trailing surface;

a body joined to said head and being in fluid communication with a vacuum source;

at least one vacuum slot disposed in said head and defining an aperture on said web-facing surface between said leading surface and said trailing surface, said at least one vacuum slot extending from said web-facing surface to said body;

said at least one leading surface having a textured area in the region juxtaposed with said aperture, said textured area comprising a plurality of sealing areas which are discrete relative to each other in both said machine direction and said cross-machine direction, said sealing areas being separated from one another by a continuous reticulated network of passageways extending in at least two mutually intersecting directions, said network being in fluid communication with said at least one vacuum slot, to provide a leakage between said at least one leading surface and the papermaking belt, said textured area further comprising a transitional area having a predetermined Z-spacing from the papermaking belt, said Z-spacing gradually increasing in said machine direction, whereby the amount of vacuum pressure applied through said vacuum slot to the papermaking belt increases as the papermaking belt travels in said machine direction in front of said aperture.

13. The apparatus according to claims 1, 11, or 12, wherein said network of passageways comprises grooves oriented in at least said machine direction and said cross-machine direction.

14. A vacuum apparatus in a papermaking machine having a machine direction and a cross-machine direction perpendicular to said machine direction, in combination with a papermaking belt having a web-contacting surface, a backside surface, and a plurality of deflection conduits extending therebetween, each of said conduits having a cross-machine dimension, said vacuum apparatus comprising:

a head having a web-facing surface supporting said papermaking belt;

a body joined to said head and being in fluid communication with a vacuum source;

at least one vacuum slot disposed in said head and defining an aperture on said web-facing surface, said at least one vacuum slot extending from said web-facing surface to said body;

said web-facing surface having a textured area in the region juxtaposed with said aperture, said textured area comprising a plurality of sealing areas separated from one another by a plurality of passageways in fluid communication with said at least one vacuum slot, each of said sealing areas having a cross-machine dimension which is less than said cross-machine dimension of each of said conduits of said papermaking belt, thereby providing leakage in said textured area between said web-facing surface and said papermaking belt.

15. The apparatus according to claim 14, wherein said textured area comprises grooves oriented in said machine direction.

* * * * *

UNITED STATES PATENT AND TRADEMARK OFFICE

CERTIFICATE OF CORRRECTION

PATENT NO. : 5,744,007
DATED : APRIL 28, 1998
INVENTOR(S) : PAUL DENNIS TROKHAN ET AL.

It is certified that error appears in the above-identified patent and that said Letters Patent is hereby corrected as shown below:

On the title page: Item [56]

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 4 | 4 | 0 | 5 | 9 | 7 | 4/3/84 | Wells, et al | 162 | 111 | |
| | | 5 | 0 | 3 | 4 | 1 | 0 | 0 | 7/23/91 | Sides | 162 | 306 | |

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 2 | 105 | 091 | | | | | 5/25/72 | Germany | | | | |
| | | | | | | | | | | | | | | |
| | | | | | | | | | | | | | | |

UNITED STATES PATENT AND TRADEMARK OFFICE

CERTIFICATE OF CORRECTION

PATENT NO. : 5,744,007

DATED : APRIL 28, 1998

INVENTOR(S) : PAUL DENNIS TROKHAN ET AL.

It is certified that error appears in the above-identified patent and that said Letters Patent is hereby corrected as shown below:

Column 8, line 55 of the issued patent, delete "curbed" and insert therefor -- curved --.

Column 17, line 53 of the issued patent, after Comprising, delete ",".

Column 25, lines 20-21 of the issued patent, delete "vacuum slot 216d(1), 216f(1), 216g(1) to a last vacuum slot 216d(3), 216f(3),".

Signed and Sealed this

Seventeenth Day of August, 1999

*Attest:*

Q. TODD DICKINSON

*Attesting Officer*

*Acting Commissioner of Patents and Trademarks*